US007424232B2

(12) United States Patent
Takahashi et al.

(10) Patent No.: US 7,424,232 B2
(45) **Date of Patent: *Sep. 9, 2008**

(54) CHARGING APPARATUS

(75) Inventors: Norio Takahashi, Suntoh-gun (JP); Harumi Ishiyama, Numazu (JP); Jun Hirabayashi, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 22 days.

This patent is subject to a terminal disclaimer.

(21) Appl. No.: 11/476,137

(22) Filed: Jun. 28, 2006

(65) Prior Publication Data

US 2006/0245775 A1 Nov. 2, 2006

Related U.S. Application Data

(62) Division of application No. 10/836,280, filed on May 3, 2004, now Pat. No. 7,116,922.

(30) Foreign Application Priority Data

May 2, 2003 (JP) ..... 2003-127052
Apr. 16, 2004 (JP) ..... 2004-121326

(51) Int. Cl.
*G03G 15/02* (2006.01)

(52) U.S. Cl. ..... 399/50; 399/176

(58) Field of Classification Search ..... 399/38, 399/46, 50, 76, 89, 107, 115, 176
See application file for complete search history.

(56) References Cited

U.S. PATENT DOCUMENTS 5,708,932 A 1/1998 Yano et al. ..... 399/159
5,729,802 A 3/1998 Hirabayashi et al. ..... 399/174
5,930,566 A 7/1999 Ishiyama ..... 399/168
6,038,418 A 3/2000 Chigono et al. ..... 399/174
6,038,420 A 3/2000 Hirabayashi et al. ..... 399/176
6,118,965 A 9/2000 Hirabayashi et al. ..... 399/175
6,163,671 A 12/2000 Ishiyama et al. ..... 399/176
6,212,346 B1 4/2001 Hirabayashi et al. ..... 399/176
6,226,480 B1 5/2001 Hirabayashi et al. ..... 399/222
6,233,419 B1 5/2001 Chigono et al. ..... 399/176
6,298,205 B1 10/2001 Chigono et al. ..... 399/174
6,421,512 B2 7/2002 Watanabe et al. ..... 399/149
6,473,582 B2 10/2002 Ishiyama et al. ..... 399/175
6,512,905 B1 * 1/2003 Tomiki et al. ..... 399/115
6,519,433 B1 2/2003 Hirabayashi et al. ..... 399/174
6,532,347 B2 3/2003 Watanabe et al. ..... 399/50
6,539,184 B2 3/2003 Shimura et al. ..... 399/50
6,842,591 B2 1/2005 Shim et al. ..... 399/50
6,889,023 B2 * 5/2005 Suda et al. ..... 399/176
7,046,943 B2 * 5/2006 Yamazaki ..... 399/176
7,113,726 B2 * 9/2006 Tokumasu et al. ..... 399/176

FOREIGN PATENT DOCUMENTS

JP 10/232534 9/1998

* cited by examiner

*Primary Examiner*—Hoan H Tran
(74) *Attorney, Agent, or Firm*—Fitzpatrick, Cella, Harper & Scinto

(57) ABSTRACT

A charging apparatus includes a charger for being supplied with an AC voltage and for electrically charging a member to be charged; a current measurer for measuring a current flowing between the charger and the member to be charged when the AC voltage is supplied to the charger; and a particular current extractor for extracting from the current a particular current having a particular frequency.

15 Claims, 14 Drawing Sheets

CHARGING APPARATUS

This is a division of application Ser. No. 10/836,280, filed on May 3, 2004.

FIELD OF THE INVENTION AND RELATED ART

The present invention relates to a charging apparatus for an electrophotographic image forming apparatus.

A corona type charging device has long been widely used as an apparatus for charging the peripheral surface of an image bearing member, such as a photosensitive member or the like, in an image forming apparatus, for example, an electrophotographic recording apparatus or an electrostatic recording apparatus. A corona type charging device is not placed in contact with an object to be charged. More specifically, it is set up so that its corona discharging opening faces an object to be charged, and the surface of the object is charged to predetermined polarity and potential level by being exposed to the corona current discharged through the corona discharging opening of the charging device. A corona type charging device, however, has a few problems. For example, it requires a high voltage power source, and it is low in charge efficiency. It generates a large amount of by-products such as ozone, nitrogen oxides, and the like due to corona discharge, and its discharge wire is easily contaminated.

In recent years, contact type charging apparatuses have been put to practical use, which are characterized in that they are lower in power consumption, higher in charge efficiency, and smaller in the amount of the by-products attributable to electrical discharge, compared to a corona type charging device. They comprise an electrically conductive charging member, which is to be placed in contact with an object to be charged, for example, a photosensitive member. In operation, voltage is applied to the charging member to induce electrical discharge between the charging member and the object to be charged, so that the peripheral surface of the object is charged to a predetermined potential level.

Even if the charging member is not placed in contact with an object to be charged, in other words, even if there is a gap between the charging member and the object to be charged, the object can be charged by charging a predetermined bias to the charging member, as well as it would be if the two were in contact with each other, as long as the gap is small enough to allow electrical discharge to occur between the charging member and object.

The present invention also relates to the above described charging method in which a gap small enough to allow discharge to occur between a charging member and an object to be charged is provided between the charging member and the object.

The shape of a charging member is optional. For example, a charging member may be in the form of a roller, a blade, a rod, a brush, or the like. Among the various charging methods different in the shape of the charging member they employ, the method which employs an electrically conductive roller is widely used because it is stable in performance.

The charging methods employing a contact type charging apparatus can be roughly divided into two types: "DC type" and "AC type". In a charging method of the DC type, DC voltage is applied to the charging member to charge an object, whereas in a charging method of the AC type, a combination of DC voltage and AC voltage is applied to the charging member in order to charge an object.

In either charging method, the surface of an object to be charged is charged to a predetermined potential level by the contact charging member to which charge bias is being applied.

In the case of a charging method of the AC type, there are a contact area, in which the charging member is in contact with an object to be charged, and a separation area which is immediately downstream of the contact area, in terms of the direction in which the surface of the object moves, and in which the distance between the surfaces of the charging member and object gradually increases as the distance from the contact area increases. To the charging member, a combination of DC voltage and AC voltage (peak-to-peak voltage of which is twice, or greater than, the voltage level Vth at which an object begins to be charged when DC voltage applied to the charging member is gradually increased) is applied as the charge bias to the charging member. As the charge bias is applied to the charging member, an oscillatory electric field is generated between the surface of the object be charged, and charging member, in the abovementioned separation area. As a result, the surface of the object is made uniform in potential level, by the AC component of the charge bias, and the potential level of the surface of the object converges to a predetermined potential level.

As for the waveform of the AC voltage, voltage having a sinusoidal waveform is most commonly used. But, the waveform of the AC voltage may be rectangular, triangular, or pulsatory.

In the case of a charging method of the AC type, the alternating discharge current which flows between a charging member and an object to be charged is related to the AC component of the charge bias. Thus, the charging method Of the AC type has the following problems. That is, if the AC component is excessive, the alternating discharge current between the charging member and object to be charged, becomes excessive. As a result, the rate at which the object, which is an image bearing member in the case of an image forming apparatus, is deteriorated, for example, shaved, is accelerated, and/or a large amount of the by-products resulting from discharge adhere to the image bearing member, effecting defective images, for example, images which appear smeared, when temperature and humidity are high.

On the other hand, if the AC component is excessively small, the alternating discharge current which flows between the charging member and the object to be charged becomes too small, causing the image forming apparatus which employs the charging method of the AC type, to output defective images, for example, images which appear as if they are covered with sands (image defect attributable to local excessive discharge), and images having horizontal streaks (image defects attributable to occurrences of excessive discharge across areas in the lengthwise direction of the object to be charged, and very short in the circumferential direction of the object).

In order to solve these problems, it is necessary to minimize the alternating discharge current between the charging member and the object, and in order to minimize the alternating discharge current between the charging member and the object, it is necessary to minimize the AC voltage. However, these objectives must be accomplished while keeping the AC voltage within the range in which the object can be uniformly charged.

The relationship between the AC voltage applied to a charging member and the alternating discharge current which flows between the charging member and an object to be charged, is not constant. For example, in the case of an image forming apparatus, the relationship between the AC voltage applied to the charging member, and the alternating discharge current which flows between the image bearing member and charging member is affected by such factors as the electrical resistance, film thickness, permittivity, etc., of the image bearing member as an object to be charged, such factors as the electrical resistance, permittivity, extent of surface contamination, etc., of the charging member, and such factors as the temperature, humidity, etc., of the ambience. Given below are the examples of such relationships.

As the film thickness of the image bearing member, as an object to be charged, of an image forming apparatus reduces, the firing potential Vth, that is, the voltage level at which the image bearing member begins to be charged as the DC voltage being applied to the charging member increased, decreases, resulting in decrease in the voltage level at which the alternating discharge current begins to flow between the charging member and image bearing member.

Further, the firing potential Vth is higher in the low temperature-low humidity (L/L) ambiance and is lower in the high temperature-high humidity (H/H) ambience. Therefore, the voltage level at which the alternating discharge current begins to flow between the charging member and image bearing member is higher in the L/L ambiance, and is lower in the H/H ambience.

Thus, "AC current controlling method", which keeps constant the amount of the AC current resulting from the application of AC voltage to the charging member has been proposed as one of the solutions to the above described problem. The employment of this AC current controlling method makes it possible to reduce the amount by which the alternating discharge current is changed by the changes in the film thickness of the image bearing member as an object to be charged, and ambience factors such as temperature or humidity changes.

However, this "AC current controlling method" suffers from the following problems. That is, the relationship between the AC voltage applied to the charging member, and the alternating discharge current which flows between the charging member and image bearing member, is affected by the cumulative number of the copies outputted from an image forming apparatus; it becomes different from what it is when it is used for the first time. Thus, if the current level of the AC current is set to a value which is satisfactory from the first time usage of an image forming apparatus or a process cartridge, to a point in the service life thereof, at which a substantial number of copies will have been outputted, the amount of the alternating discharge current becomes substantially larger than the optimal amount at the first usage. As a result, the rate with which the image bearing member is shaved accelerates in the latter half of the service life thereof, causing thereby the image forming apparatus to output images suffering from the defects attributable to the by-products of discharge.

Further, the alternating discharge current increases or decreases due to the individual differences among charging members, or high voltage generating apparatuses, resulting from manufacturing errors, etc. Thus, in order to control the increase or decrease in the alternating discharge current, it is necessary to control the changes in the amount of the alternating discharge current resulting from the changes in the properties of the image bearing member, changes in the properties of the charging member, changes in the such factors as temperature or humidity in the ambience, and individual differences among charge rollers. Therefore, the cost for controlling the changes in the alternating discharge current is substantial.

Thus, there have been proposed various methods for keeping the alternating discharge current constant regardless of the abovementioned changes in the aforementioned various factors which affect the amount of the alternating discharge current.

According to the proposal disclosed in Japanese Laid-open Patent Application 10-232534, in order to make the amount of the alternating discharge current fall within a predetermined range, the charge bias to be applied to the charging member is controlled by dividing the total alternating current which flows between the charging member and object to be charged, into two components, that is, the component (non-discharge component) which flows between the charging member and object in the charging nip, and the component (discharge component) which flows between the charging member and object, through the minute gap between the two.

In the case of U.S. Pat. No. 6,539,184, attention was paid to the fact that in terms of the relationship between the waveform of the AC voltage applied to the charging member, and elapsed time, the period in which the alternating discharge current flows corresponds to the adjacencies of the peak of the waveform of the applied voltage. Thus, the voltage level is read at a point in time (waveform phase) which corresponds to the peak of the wave form of the applied voltage, and the peak-to-voltage Vpp of the AC voltage to be applied to the charging member is adjusted so that the amount of the alternating discharge current assumes a predetermined value. In other words, the alternating discharge current is controlled by using a value related to the total amount of the alternating discharge current.

In the case of U.S. Pat. No. 6,532,347, the amount of the alternating current is measured at one or more points while applying to the charging member such direct voltage that is no more than twice the voltage level Vth at which the object begins to be charged as the DC voltage being applied to the charging member is gradually raised, and at no less than two points while applying to the charging member such voltage that is no less than twice the voltage level Vth at which the object begins to be charged as the DC voltage being applied to the charging member is gradually raised. Then, the AC voltage is controlled so that the amount of the alternating current assumes a predetermined value.

By keeping the amount of the alternating discharge current to a predetermined value using one of the above described proposals, it is possible to eliminate the effects of the changes in the properties of the image bearing member as an object to be charged, changes in the properties of the charging member, changing in such aspects as temperature or humidity of the ambience, and individual differences among charging members, upon the process for charging an object (image bearing member), and therefore, the object can be reliably charged.

In the case of the above described charging methods, however, the alternating discharge current is minimized, and therefore, it is substantially smaller in comparison to the total amount of the alternating current. Therefore, the effect of the measurement errors upon the charging process is substantial. In other words, in order to uniformly charge an object to prevent the formation of abnormal images regardless of the measurement errors, the amount of the alternating discharge current must be set to a relatively large value.

In the case of the controls executed in the above described proposals, an averaging process is used to minimize the amount of the measurement error. However, it takes a long time to improve, by averaging, the accuracy with which the abnormal discharge current is measured.

Also in the case of the above described proposals, the value of the total amount of the alternating discharge current, or a value proportional to the total amount of the alternating discharge current, is used for control. Therefore, they cannot detect transient abnormal discharge, which is the cause of the local charging errors. In other words, in the case of an image forming apparatus, the local charging errors which result in the formation of images suffering from such defects as sandy appearance or horizontal streaks cannot be detected in the charge bias control process.

SUMMARY OF THE INVENTION

The present invention is for solving the above described problems.

The primary object of the present invention is to satisfactorily charge such an object as an image bearing member, regardless of the changes in the properties of the object, changes in the properties of a charging member, changes in such factors as temperature or humidity in the ambience, and individual differences among charge rollers.

Another object of the present invention is to uniformly charge an object by improving the accuracy with which the charge bias to be applied to the charging member is determined, and also, to reduce the amount of the alternating discharge current which needs to be flowed between the charging member and an object to be charged, compared to the prior art.

Another object of the present invention is to reduce the length of the time necessary for control.

Another object of the present invention is to prevent the local charging errors.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferred embodiments of the present invention will be described with reference to the appended drawings.

Embodiment 1

1) Structure of Printer

Figure 1:
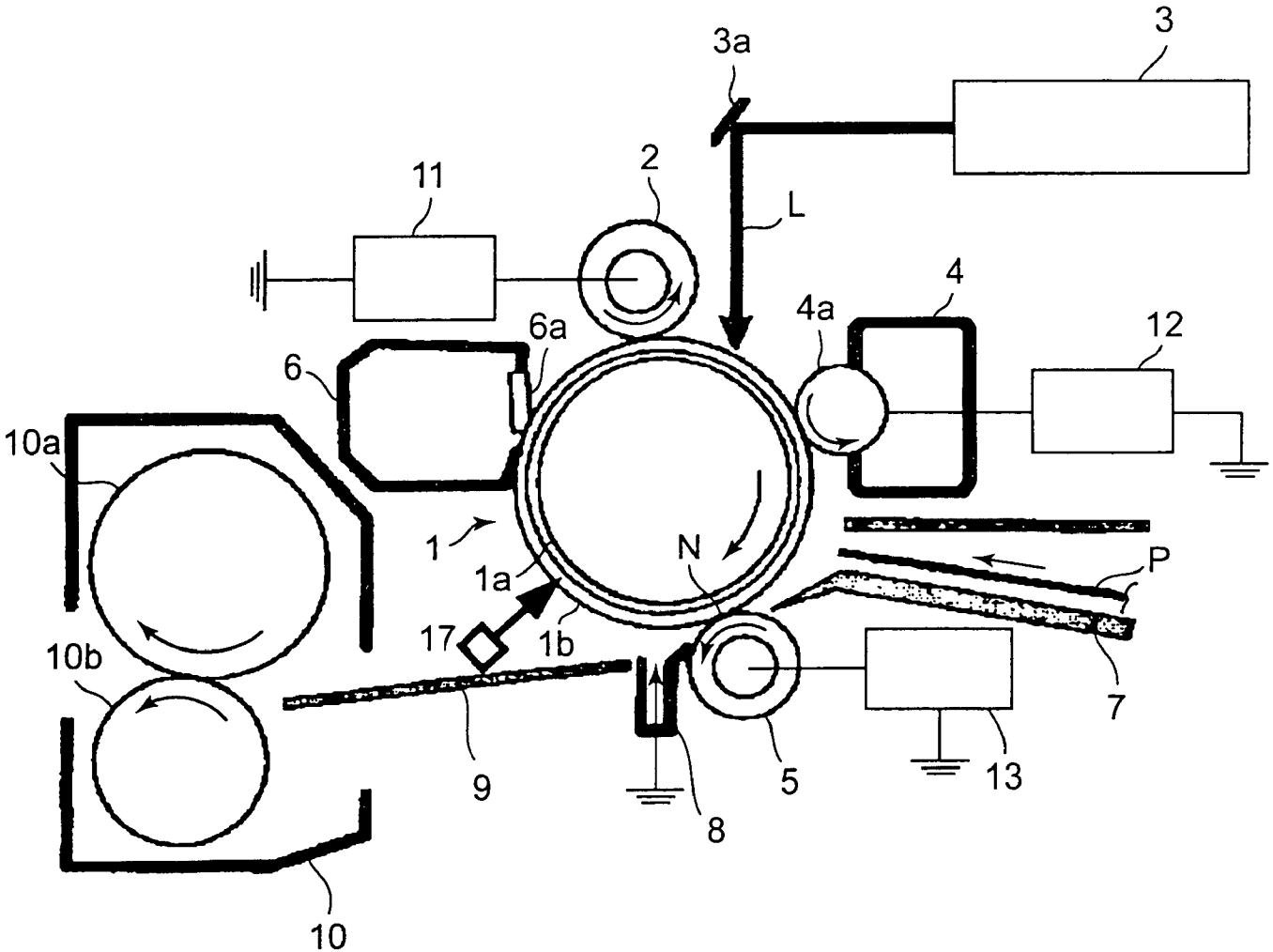
FIG. 1 is a schematic sectional view of the image forming apparatus in the first embodiment of the present invention, showing the general structure thereof.

FIG. 1 is a schematic sectional view of the image forming apparatus in the first embodiment of the present invention, showing the general structure thereof. The image forming apparatus in this embodiment is an electrophotographic laser beam printer.

This image forming apparatus is equipped with a photosensitive drum 1 as an image bearing member. Disposed around the photosensitive drum 1 are a charge roller 2, a developing apparatus 4, a transfer roller 5, a cleaning apparatus as a foreign object removing means for removing by-products of discharge, residual toner, etc. Disposed above the developing apparatus 4 is an exposing apparatus 3. There is also provided a transfer guide 7, on the upstream side of the transfer nip N between the photosensitive drum 1 and transfer roller 5, in terms of the transfer medium conveyance direction. On the downstream side of the transfer nip N in terms of the transfer medium conveyance direction, a charge removal needle 8, a conveyance guide 9, and a fixing apparatus 10 are disposed.

The photosensitive drum 1 in this embodiment is an organic photosensitive member, the inherent polarity of which is negative. It comprises an aluminum substrate 1*a* in the form of a drum, and a photosensitive layer 1*b* which covers the peripheral surface of the substrate 1*a*. It is rotationally driven in the direction (clockwise direction) indicated by an arrow mark, at a predetermined peripheral velocity. As the photosensitive drum 1 is rotationally driven, it is uniformly charged to the negative polarity by the charge roller 2 placed in contact with the photosensitive drum 1.

The charge roller 2, which is a charging means of the contact type, is rotatably supported, and is placed in contact with the peripheral surface of the photosensitive drum 1. As charge bias (which will be described later) is applied to the charge roller 2 from a charge bias power source 11, the photosensitive drum 1 is uniformly charged to predetermined polarity and potential level.

The exposing apparatus 3 comprises a laser driver, a laser diode, a polygon mirror, etc., which are unshown. It operates in the following manner: Its laser diode emits a beam of laser light L from its laser diode, while modulating the laser light with the image formation data, in the form of sequential digital image formation signals, inputted into the laser driver from a personal computer or the like. The emitted laser light is oscillated by the polygon mirror which is being rotated at a high speed, and is reflected by the reflection mirror 3*a* toward the photosensitive drum 1, exposing the peripheral surface of the photosensitive drum 1. As a result, an electrostatic latent image, which reflects the image formation data, is formed on the peripheral surface of the photosensitive drum 1.

The developing apparatus 4 is provided with a development sleeve 4*a*, which is rotatably disposed so that its peripheral surface is placed virtually in contact with the peripheral surface of the photosensitive drum 1, in the development station. As development bias is applied to the development sleeve 4*a* from a development bias power source 12, the toner on the peripheral surface of the development sleeve 4*a* is adhered to the peripheral surface of the photosensitive drum 1 in the pattern of the electrostatic latent image, in the development station; the latent image is developed into a visible image formed of toner (which hereinafter will be referred to simply as toner image).

The transfer roller 5 forms a transfer nip N by being pressed upon the peripheral surface of the photosensitive drum 1 with the application of a predetermined amount of pressure. As transfer bias is applied to the transfer roller from a transfer bias power source 13, the toner image on the peripheral surface of the photosensitive drum 1 is transferred onto a transfer medium P, in the transfer nip N between the photosensitive drum 1 and transfer roller 5.

The cleaning apparatus 6 is provided with a cleaning blade 6*a*, which removes the transfer residual toner, that is, the toner remaining on the peripheral surface of the photosensitive drum 1 after the transfer.

The fixing apparatus 10 is provided with a fixation roller 10*a* and a pressure roller 10*b*, which are rotatably supported in a manner to form a fixation nip between them. As the transfer medium P is conveyed through the fixation nip while remaining nipped by the two rollers 10*a* and 10*b*, the toner image having just been transferred onto the transfer medium P is thermally fixed to the transfer medium P by the heat and pressure in the fixation nip.

A pre-exposing apparatus 17 located upstream of the charging station exposes the peripheral surface of the photosensitive drum 1 in order to reduce the potential level of the peripheral surface of the photosensitive drum 1 to 0 V.

Next, the image forming operation of the above described image forming apparatus will be described.

During an image forming operation, the photosensitive drum 1 is rotated by a driving means (unshown) in the direction indicated by the arrow mark at a predetermined peripheral velocity, and as it is rotated, its peripheral surface is uniformly charged by the charge roller 2 to which charge bias is being applied.

Then, the charged portion of the peripheral surface of the photosensitive drum 1 is exposed to the beam of laser light L projected from the exposing apparatus 3 while being modulated with the image formation data inputted from a personal computer (unshown) or the like. As a result, an electrostatic latent image, which reflects the image formation data, is formed on the peripheral surface of the photosensitive drum 1.

Next, toner charged to the same polarity as the polarity (negative) to which the peripheral surface 1 has been charged is adhered to the electrostatic latent image on the photosensitive drum 1, in the development station, by the development sleeve 4*a* of the developing apparatus 4, to which development bias having the same polarity as the polarity (negative) to which the photosensitive drum 1 has been charged is being applied. As a result, the latent image is developed into a visible image, or a toner image.

Next, as the toner image on the photosensitive drum 1 is moved toward the transfer nip N by the further rotation of the photosensitive drum 1, the transfer medium P, for example, printing paper, is fed into the main assembly of the image forming apparatus, so that it will be moved into the transfer nip N through the transfer guide 7, in synchronism with the arrival of the toner image at the transfer nip N.

In the transfer nip N, the toner image on the photosensitive drum 1 is transferred by the transfer roller 5 to which transfer bias opposite (positive) in polarity to the toner, onto the transfer medium P, which is being conveyed through the transfer nip N; the toner image is transferred by the electrostatic force induced between the photosensitive drum 1 and transfer roller 5.

After the transfer of the toner image onto the transfer medium P, the transfer medium P is cleared of electric charge by the charge removal needle 8. Then, it is conveyed to the fixing apparatus 10 through the conveyance guide 9. In the fixing apparatus 10, the toner image on the transfer medium P is thermally fixed to the transfer medium P by heat and pressure while the transfer medium P is conveyed through the fixation nip between the fixation roller 10 and pressure roller 10*b*. Then, the transfer medium P is discharged from the main assembly of the image forming apparatus, ending the image forming sequence for forming a single copy of an intended image.

Meanwhile, the transfer residual toner, or the toner remaining on the peripheral surface of the photosensitive drum 1 after the transfer of the toner image, is removed by the cleaning blade 6*a* of the cleaning apparatus 6, and is recovered.

2) Detailed Description of Charging Apparatus

A) Charge Roller 2

Figure 2:
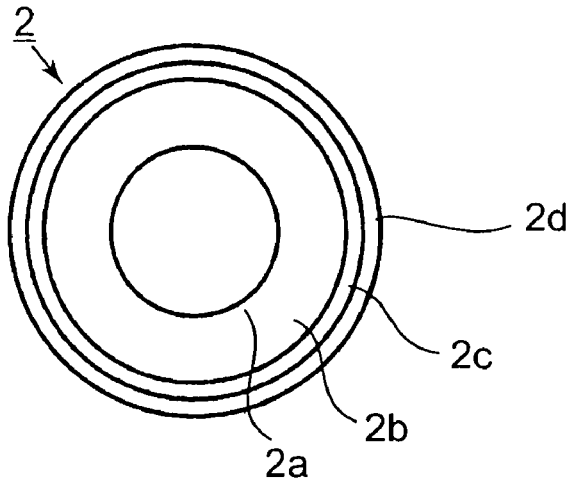
FIG. 2 is a schematic cross-sectional view of the charge roller in the first embodiment of the present invention.

In this embodiment, the charge roller 2 is employed as the contact charging member. The general structure of the charge roller 2 is shown in FIG. 2. The charge roller 2 has a laminar structure; it comprises a metallic core (supporting member) 2*a* and functional three layers, that is, a bottom layer 2*b*, an intermediary layer 2*c*, and a surface layer 2*d*, which are layered in this order from the bottom, on the peripheral surface of the metallic core 2*a*. The bottom layer 2*b* is formed of foamed sponge, and is for minimizing the charging noises. The intermediary layer 2*c* is an electrically conductive layer, and is for making uniform the overall electrical resistance of the charge roller 2. The surface layer 2*d* is a protective layer, and is for preventing electrical leakage even if the surface layer of the photosensitive drum 1 has such a defect as a pinhole.

B) Charging Apparatus

Figure 3:
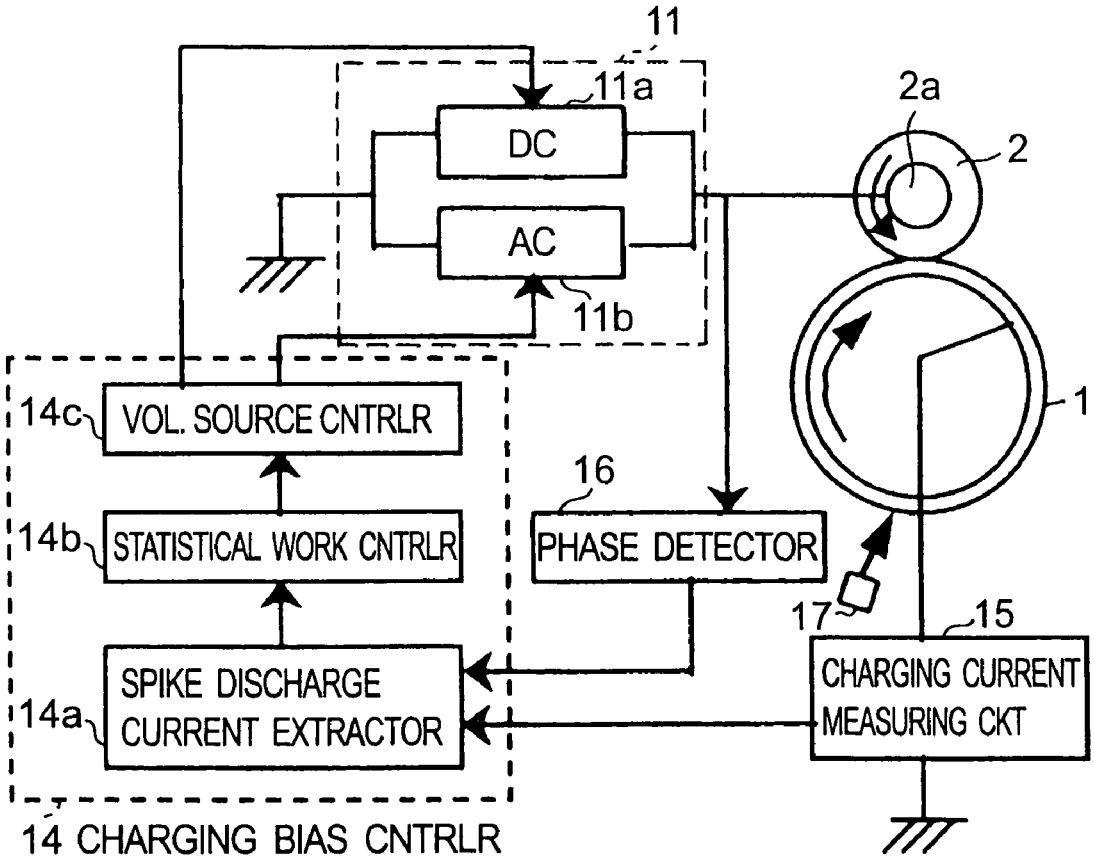
FIG. 3 is a schematic sectional view of the charging apparatus in the first embodiment of the present invention, showing the general structure thereof.

FIG. 3 is a schematic drawing of the charging apparatus, showing the general structure thereof. As the combination of DC voltage and AC voltage is applied to the charge roller 2 (more specifically, the metallic core 2*a* of the charge roller 2) from the charge bias power source 11, the peripheral surface of the photosensitive drum 1, which is being rotated, is charged to a predetermined potential level.

The charge bias power source 11 from which voltage is applied to the charge roller 2 has a DC power source 11*a* and an AC power source 11*b*.

A charge current measurement circuit 15 as a current measuring means measures the charge current which flows to the charge roller 2 through the photosensitive drum 1. This charge current, which is measured by the circuit 15, is inputted into a control circuit 14, which will be described next.

The charge bias control circuit 14 comprises a current detecting circuit 14*a* as a means for detecting current of a specific type, a statistical process circuit 14*b*, and a power source control circuit 14*c* as a controlling means.

The specific current detecting circuit 14*a* has a function of detecting current of a specific type, more specifically, the current having a specific frequency, based on the current information inputted through the charge current measurement circuit 15. In this embodiment, the specific frequency ft is: $ft \geqq 10{,}000$ (Hz), or $ft \geqq 10 \cdot f$.

The statistical process circuit 14*b* has a function of statistically processing the data carried by the current with a specific frequency inputted from the special current detecting circuit 14*a*, using a predetermined method, and a function of outputting a command for controlling the power source control circuit 14*c*, based on the results of the process.

The power source control circuit 14*c* has a function of turning on or off the abovementioned DC power source 11*a* and AC power source 11*b* of the charge bias power source 11 in such a manner that either DC or AC voltage, or both DC and AC voltages, are applied to the charge roller 2, and a function of controlling the DC voltage to be applied to the charge roller 2 from the DC power source 11*a*, and the peak-to-peak voltage of the AC voltage to be applied to the charge roller 2 from the AC power source 11*b*. In this embodiment, the data carried by the current having the specific frequency, inputted from the special current detecting circuit 14*a*, are statistically processed by the statistical processing circuit 14*b*, and then, signals are sent to the power source control circuit 14*c*. However, the charging apparatus may be structured so that the data carried by the current with a specific frequency is directly inputted into the power source control circuit 14*c*.

The charge bias control circuit 14, which is an integration of these circuits 14*a*, 14*b*, and 14*c*, has a function of controlling the AC voltage to be applied to the charge roller 2, based on the charge current data inputted from the charge current measurement circuit 15, in order to minimize the discharge between the photosensitive drum 1 and charge roller 2 while preventing the photosensitive drum 1 from being unsatisfactorily charged.

Designated by a referential number 16 is a phase detection circuit, which has a function of detecting the phase of the charge bias.

Designated by a referential number 17 is the pre-exposing apparatus, which exposes the peripheral surface of the photosensitive drum 1, on the upstream side of the charging station, to reduce the potential level of the peripheral surface of the photosensitive drum 1 to 0 V. It also has a function of providing a difference between the surface potential level of the photosensitive drum 1 on the upstream side of the charging station, and the potential level of the DC voltage applied to the charge roller 2, in order to assure that there will be such AC voltage that generates abnormal discharge current which is no less than a predetermined value in the maximum instantaneous current, the frequency of which is in a specific range. The abnormal discharge current will be described later.

C) Method for Controlling AC Voltage to be Applied to Charging Member

C-1) Description of Abnormal Discharge Current

The inventors of the present invention made the following discoveries. That is, provided that there is a difference between the surface potential level of the photosensitive drum 1 on the upstream side of the charging station, and the potential level of the DC voltage applied to the charge roller 2, if AC voltage is applied to the charge roller 2, current which is substantially shorter in startup time and smaller in time constant than those of a single cycle of the AC voltage, in other words, such current that is specific in frequency, more specifically, current, the frequency of which is extremely high compared to that of the AC voltage, is generated. Further, as the current with an extremely high frequency is generated, images suffering from such defects as grainy areas or horizontal streaks attributable to the local unsatisfactory charging of the photosensitive drum 1 are formed. Next, the process which results in the formation of such an imperfect image will be described in detail.

Referring to FIG. 3, the charge current measurement circuit 15 is placed between the substrate of the photosensitive drum 1 and ground. The charge current measurement circuit 15 comprises a load resistor (1 kΩ), which is substantially smaller in resistance than the charge roller 2, and a circuit for measuring the current which flows through this resistor.

The charge bias to be applied to the charge roller 2 is the combination of a DC voltage (−600 V) and an AC voltage (1 kHz in frequency, and sinusoidal in waveform). Then, the changes, in the charge current waveform. which occurred as the peak-to-peak voltage of the AC voltage was varied were examined.

Figure 4:
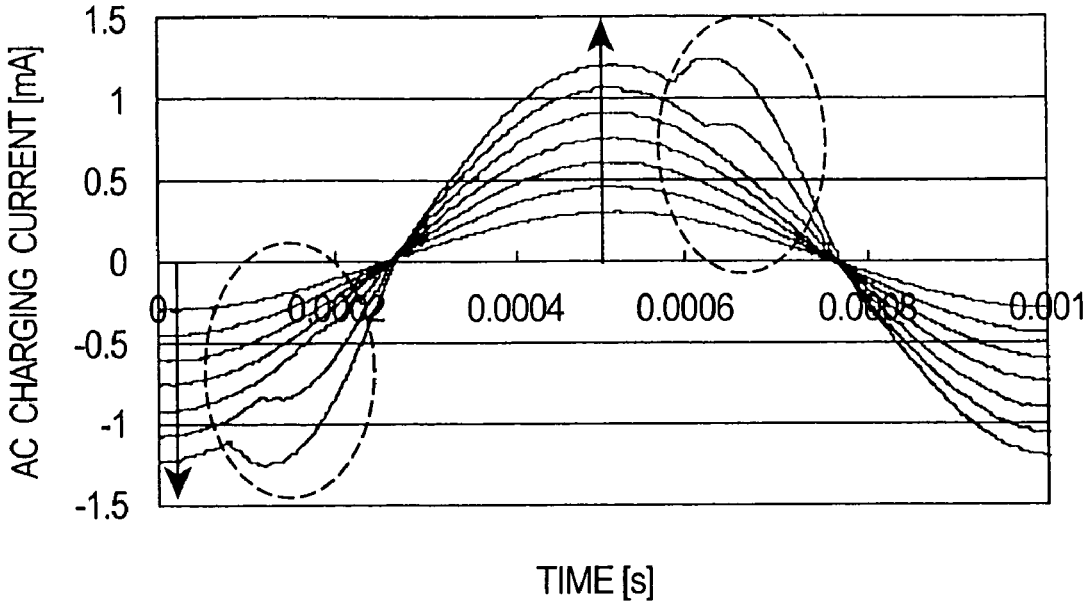
FIG. 4 is a graph showing the relationship between the average amount of the alternating charge current and elapsed time, when there was no difference between the surface potential level of the photosensitive drum, on the upstream side of the charging station, that is the contact area between the charging member and photosensitive member, and the potential level of the direct charge voltage.

FIG. 4 shows the changes, in the average value of the charge current, which occurred with the elapse of time, when there was no difference between the surface potential level of the photosensitive drum 1 on the upstream side of the charging station, and the potential level of the DC voltage applied to the charge roller 2. FIG. 4 shows the changes in alternating current, for seven AC voltages, different in peak-to-peak voltage Vpp, applied to the charge roller 2*c:* 500 V, 750 V, 1,000 V, 1,250 V, 1,500 V, 1,750 V, and 2,000 V, listing from the in ascending order. As is evident from FIG. 4, the higher the peak-to-peak voltage Vpp, the higher the peak-to-peak amount of alternating current. The lines, in FIG. 4, representing the AC voltages applied to the charge roller 2 and higher in peak-to-peak voltage Vpp than a certain value are deviated from the sinusoidal pattern, in the ranges surrounded by broken lines. In other words, the abnormal alternating discharge current flowed in these ranges. The patterns of deviation on the positive and negative sides are similar.

Figure 5:
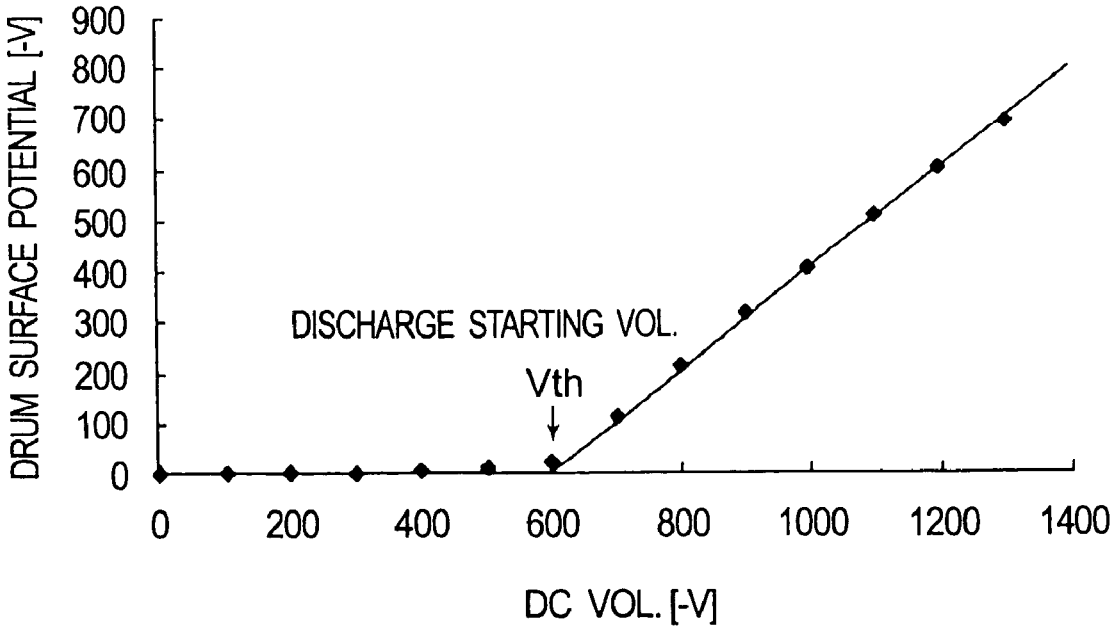
FIG. 5 is a graph showing the changes in the surface potential level of the photosensitive drum, which occur as the DC voltage being applied to the charge roller is varied in potential level.

FIG. 5 shows the changes which occurred to the surface potential level of the photosensitive drum 1 as the DC voltage applied to the charge roller 2 was varied. As is evident from FIG. 5, in the case of this experiment, the results of which are shown in FIG. 5, the voltage level Vth at which the discharge to the photosensitive drum 1 began as the DC voltage applied to the charge roller 2 was gradually increased was −600 V. It is evident from FIG. 4 that the alternating discharge current was generated when the peak-to-peak voltage Vpp was no less than 2Vth.

Figure 6:
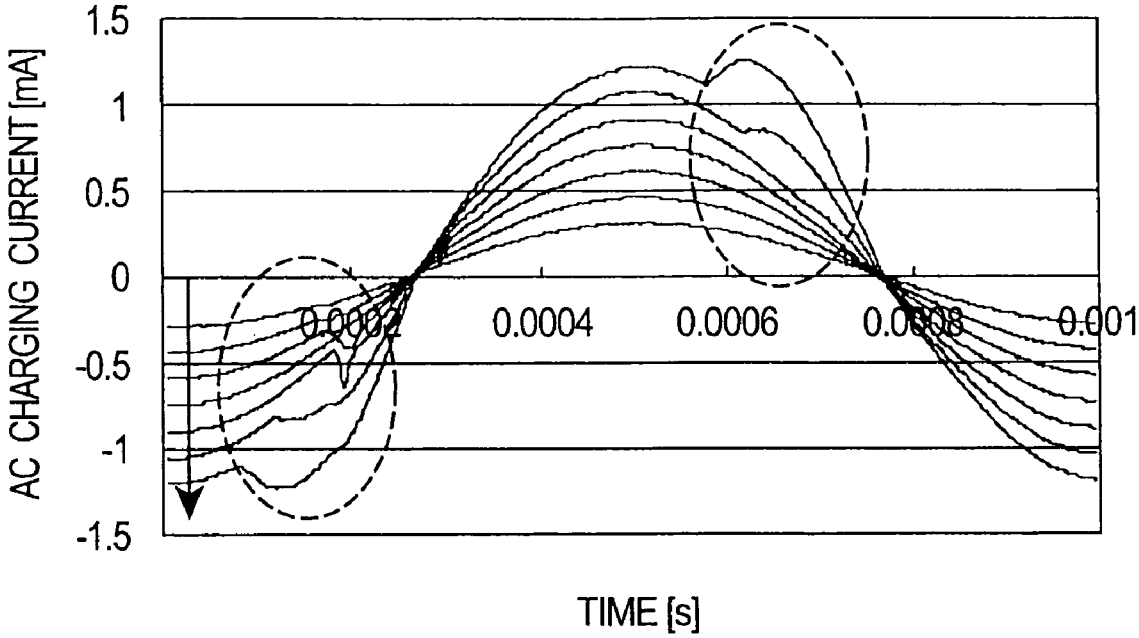
FIG. 6 is a graph showing the relationship between the average amount of the alternating charge current and elapsed time, when there was a difference between the surface potential level of the photosensitive drum, on the upstream side of the charging station between the charging member and photosensitive member, and the potential level of the direct charge voltage applied to the charging member.
Figure 7:
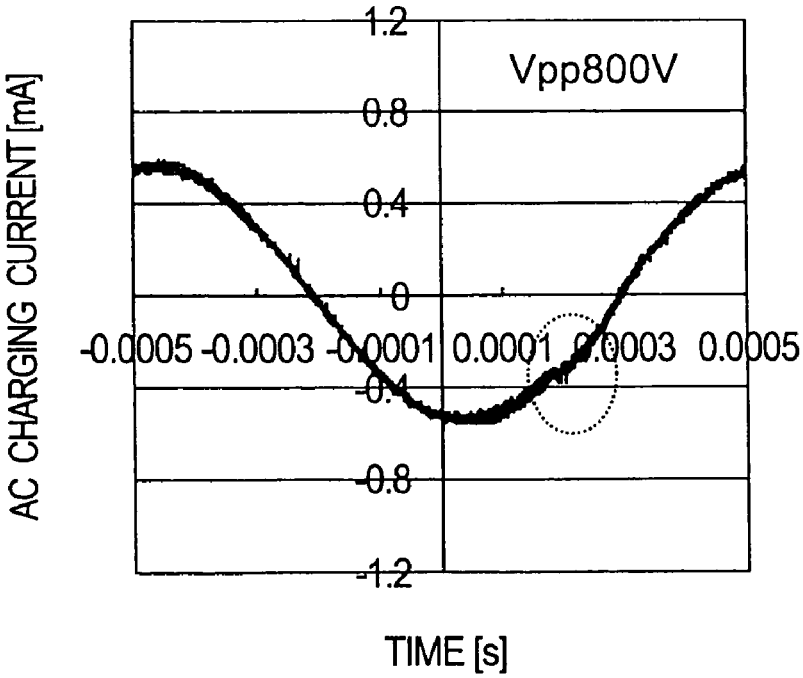
FIG. 7 is a graph showing the relationship between the average amount of the alternating charge current and elapsed time, when there was a potential level difference of 600 V between the surface potential level of the photosensitive drum, on the upstream side of the charging station between the charging member and photosensitive drum, and direct current charge voltage, and when the peak-to-peak voltage Vpp of the alternating current voltage applied to the charging member was 800 V (Vpp=800 V).

In comparison, FIG. 6 shows the average values of the changes in the alternating current, when there was a difference of 600 V between the surface potential level of the photosensitive drum 1 on the charging station, and the potential level of the DC voltage applied to the charge roller 2.

As the peak-to-peak Vpp was increased from 500 V to 2,000 V by an increment of 250 V (500 V, 750 V, 1,000 V, 1,250 V, 1,500 V, 1,750 V, 2,000 V), the peak-to-peak value of the alternating current increased. When the Vpp was higher than a certain value, the lines showing the amount of the alternating current deviated from the normal (sinusoidal) pattern, in the ranges surrounded by broken lines in FIG. 6; in other words, the abnormal alternating discharge current flowed in these ranges. In this case, on the position polarity side, the alternating discharge current increased roughly in the same pattern as that on the positive voltage side in FIG. 4. However, on the negative polarity side, the lines showing the amount of the alternating discharge display a substantial amount of deviation from the normal (sinusoidal) pattern, immediately after the beginning of the occurrence of the alternating discharge current, but, shows the normal (sinusoidal) pattern, in the range in which the amount of the alternating discharge current is greater, as do the lines in FIG. 4, on the negative polarity side.

Thus, it was assumed that when the value of the Vpp of the AC voltage applied to the charge roller 2 was in the adjacencies of the voltage value at which the alternating discharge current began to occur, the discharge current was extremely unstable. Therefore, a difference of 600 V was provided between the surface potential level on the charging station, and the potential level of the DC voltage applied to the charge roller 2. Then, the changes in the amount of the alternating charge current relative to the elapsed time were measured without averaging. Then the amount of the alternating discharge current was measured without varying the Vpp.

FIGS. 7-10, which are synchronized in charge voltage waveform, show the results of the measurements. FIGS. 7-10 show actual values of the alternating charge current measured when the Vpp was 800 V, 1,200 V, 1,450 V, and 1,700 V, respectively.

Figure 8:
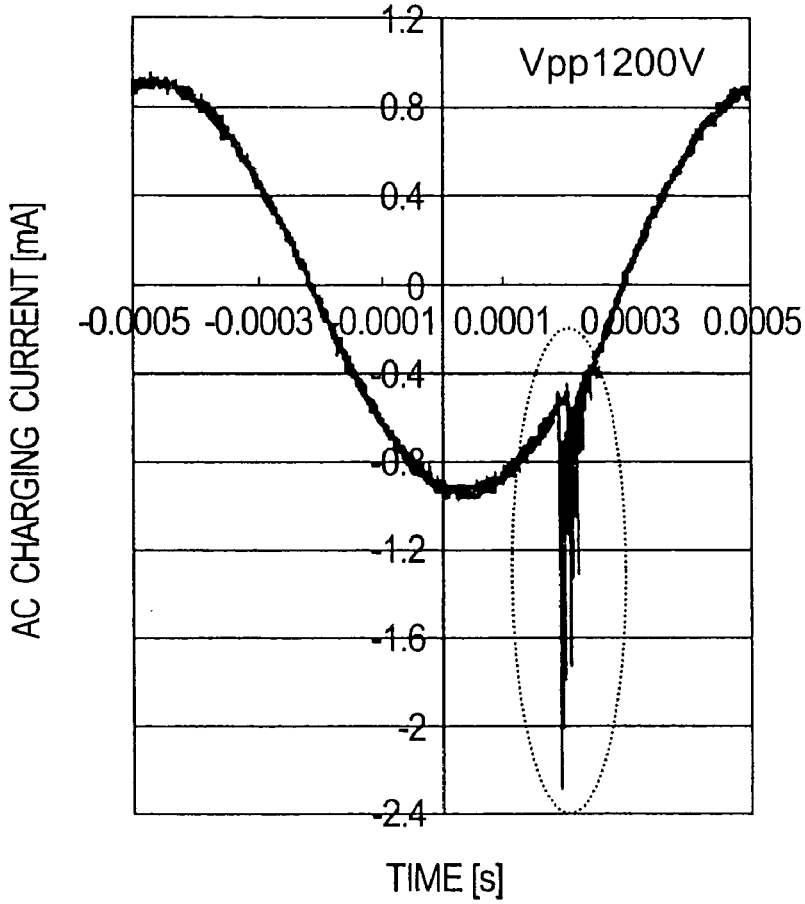
FIG. 8 is a graph showing the relationship between the average amount of the alternating charge current and elapsed time, when there was a potential level difference of 600 V between the surface potential level of the photosensitive drum, on the upstream side of the charging station between the charging member and photosensitive drum, and direct current charge voltage, and also, when the peak-to-peak voltage Vpp of the alternating current voltage applied to the charging member was 1,200 V (Vpp=1,200 V).
Figure 9:
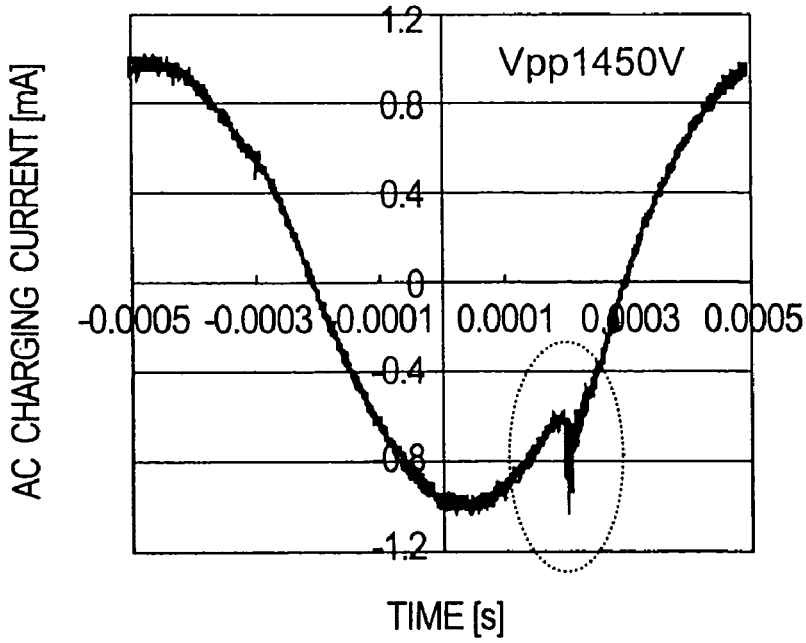
FIG. 9 is a graph showing the relationship between the average amount of the alternating charge current and elapsed time, when there was a potential level difference of 600 V between the surface potential level of the photosensitive drum, on the upstream side of the charging station between the charging member and photosensitive drum, and direct current charge voltage, and also, when the peak-to-peak voltage Vpp of the alternating current voltage applied to the charging member was 1,450 V (Vpp=1,450 V).
Figure 10:
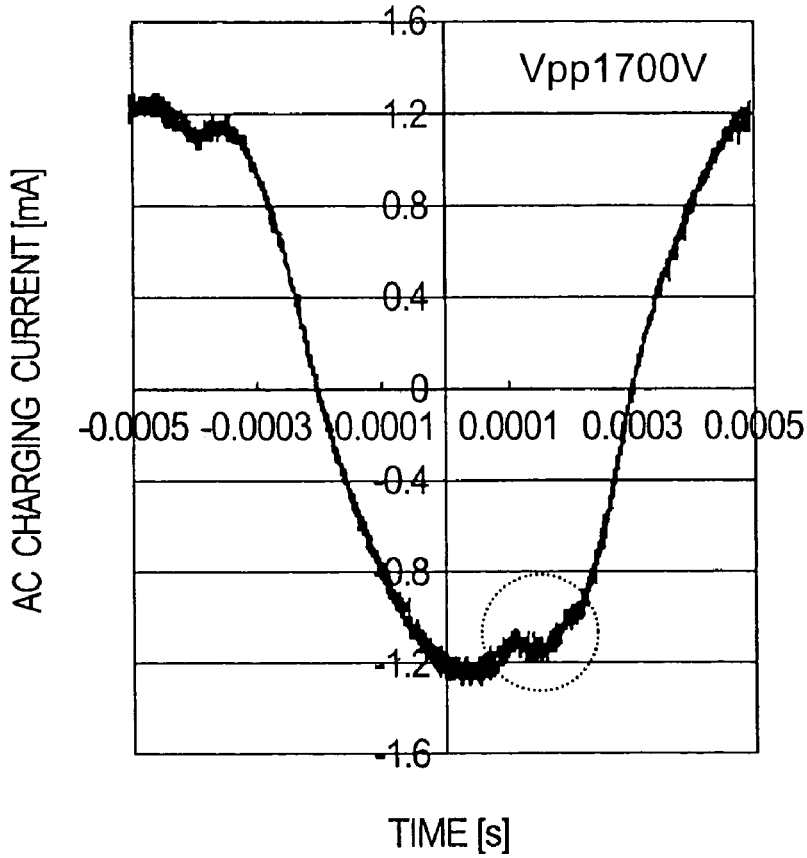
FIG. 10 is a graph showing the relationship between the average amount of the alternating charge current and elapsed time, when there was a potential level difference of 600 V between the surface potential level of the photosensitive drum, on the upstream side of the charging station between the charging member and photosensitive drum, and direct current charge voltage, and also, when the peak-to-peak voltage Vpp of the alternating current voltage applied to the charging member was 1,700 V (Vpp=1,700 V).

FIGS. 8 and 9 show the cases in which currents with a specific frequency had occurred. The amount of the alternating charge current was measured, with the AC voltage synchronized in waveform, for a length of time equivalent to a single cycle of the waveform of the AC voltage. The measurement is made three times per condition.

It is evident from FIGS. 7-10, which show, in the form of a graph, the results of the measurements, that as the Vpp of the AC voltage gradually changed from 0 V, the current with the specific frequency occurred when the Vpp of the AC voltage was roughly 2Vth, although the current with the specific frequency did not occur at the beginning of the charge. The cause for this phenomenon is as follows:

When the potential of the AC voltage is no more than 2Vth, the alternating discharge current does not occur, nor do the alternating current with a specific frequency.

When the alternating discharge current is small, the amount of discharge is too small to uniformly charge the photosensitive drum 1 in terms of the lengthwise direction of the photosensitive drum 1, or in terms of elapsed time. In other words, the alternating discharge current remains unstable, making it likely for discharge to occur locally.

When the alternating discharge current is large, the amount of discharge is large enough to uniformly charge the photosensitive drum 1 in terms of the lengthwise direction thereof, and in terms of elapsed time. Therefore, discharge remains stable.

Here, the occurrence of the abnormal discharge current was described with reference to the changes in the alternating current which occurred as the Vpp was varied. However, the same results were obtained when the AC voltage was varied in effective value Iac.

Figure 21:
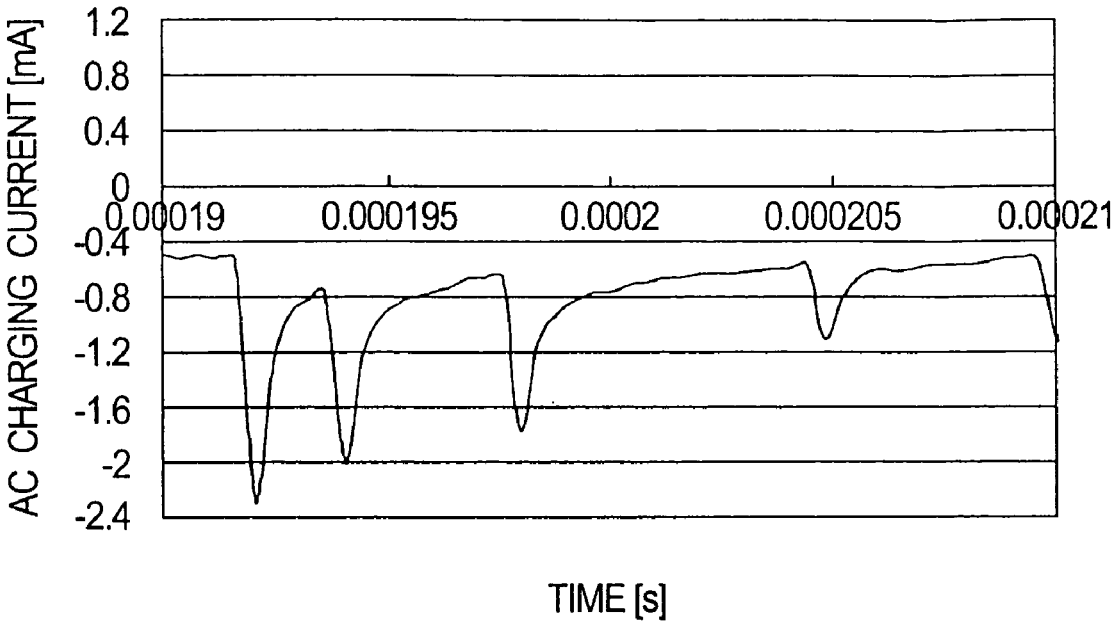
FIG. 21 is an enlargement of the portion of FIG. 8 surrounded by the broken line.

Further, it was discovered that when an image forming operation was carried out while the current with a specific frequency was large in value, inferior images were outputted. Thus, the characteristics of the abnormal discharge current which affect image quality will be described next with reference to FIG. 21, which is a magnification of the portion of FIG. 8 surrounded by the broken line.

In this embodiment, the current with a specific frequency was roughly 0.3 μs in startup time, roughly 1 μs in time constant, and roughly $10\times10^6$ Hz in frequency. Thus, its duration is substantially shorter than the length of time for a single cycle of the AC voltage applied to the charge roller 2, more specifically, 1 ms, and its frequency is higher than that of the AC voltage, that is, $10\times10^3$ Hz.

The amount of the maximum instantaneous current is affected by the Vpp of the applied AC voltage, and also, by the individual cycle thereof.

In this embodiment, there were AC voltages which generated current with a specific frequency, the maximum instantaneous current of which was greater than the effective value of the alternating current. There were also AC voltages which generated current with a specific frequency twice or more per cycle.

In this embodiment, when the surface potential level of the image bearing member on the upstream side of the charging station was 0 V, and the potential level of the DC voltage applied to the charging member was −600 V, the peripheral surface of the photosensitive drum 1 was uniformly charged, preventing thereby the formation of images suffering from defects attributable to charging process, as long as the maximum instantaneous current of the current with a specific frequency was no more than 0.2 mA. However, when the maximum instantaneous current of the current with a specific frequency was no less than 0.2 mA, the peripheral surface of the photosensitive drum 1 was not uniformly charged, resulting in the formation of images suffering from defects attributable to the charging process. This current with a specific frequency which caused the formation of images having defects attributable to the charging process is defined as "abnormal discharge current".

The value to which the maximum instantaneous current of the abnormal discharge current is to be set to prevent the unsatisfactory charging of the photosensitive drum 1 may be reset as necessary. For example, it may be reset based on the difference in potential level between the DC voltage applied to the charging means to charge the image formation area of the peripheral surface of the image bearing member, and the image bearing member.

Figure 11:
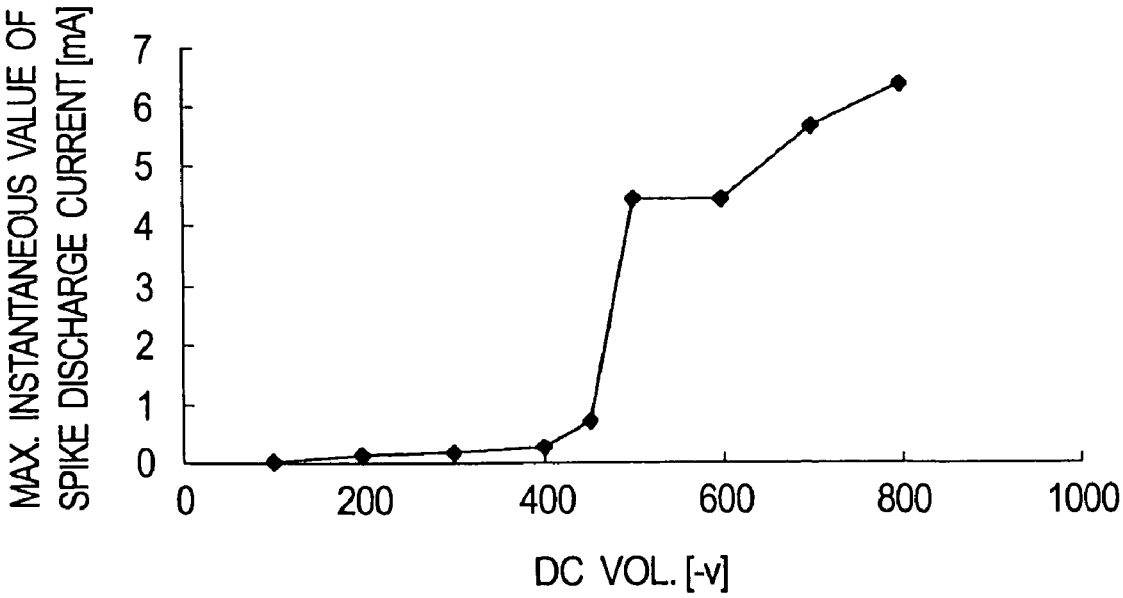
FIG. 11 is a graph showing changes in the maximum instantaneous current of the abnormal discharge current, when the surface potential level of the photosensitive drum, on the upstream side of the charging station between the charging member and photosensitive member in terms of the rotational direction of the photosensitive drum was 0 V, and the properties of the AC voltage were such that the maximum instantaneous current of the abnormal discharge current became largest as the DC voltage applied to the charge roller was varied.

FIG. 11 shows the changes in the maximum instantaneous current of the abnormal discharge current, which occurred as the DC voltage applied to the charge roller 2 was changed, when the surface potential level of the photosensitive drum 1 on the upstream side of the charging station was 0 V, and the AC voltage applied to the charge roller 2 was satisfying the condition for maximizing the maximum instantaneous current of the current with a specific frequency. It is clear from FIG. 11 that if the difference between the surface potential level of the photosensitive drum 1 on the upstream side of the charging station, and the potential level of the DC voltage applied to the charge roller 2 changes, the condition under which the current with a specific frequency occurs drastically changes. Thus, in order to precisely confirm whether or not the abnormal discharge current occurs while increasing the potential level of the peripheral surface of the photosensitive drum 1 from 0 V to a potential level Vd, a difference δV between the surface potential level of the photosensitive on the upstream side of the charging station, and the potential level of the DC voltage applied to the charge roller 2 is desired to be greater than a certain value.

In the case of the charge bias in FIG. 11, the δV is desired to be no less than 450 V, although the control is definitely possible even if the δV is no more than 450 V. In other words, all that is necessary is to provide such a difference, between the surface potential level of the image bearing member on the upstream side of the charging station, and the potential level of the DC voltage applied to the charging member, that there will be such AC voltage that generates abnormal discharge current which is no less than 1 in the SN ratio of the maximum instantaneous current of the abnormal discharge current.

C-2) Method for Deciding AC voltage Applied to Charging Member

Referring to FIG. 3, the charge current measurement circuit 15 is placed between the substrate of the photosensitive drum 1 and ground. The charge current measurement circuit 15 comprises a load resistor, the resistance (1 kΩ) of which is substantially smaller than that of the charge roller 2, and a circuit for measuring the current which flows through the resistor.

The charge bias applied to the charging member is the combination of a DC voltage (−600 V) and an AC voltage (1 kHz in frequency and sinusoidal in waveform). It is varied by varying the Vpp thereof.

In order to provide 600 V of difference between the surface potential level of the photosensitive drum 1 on the upstream side of the charging station, and the potential level of the DC voltage applied to the charge roller 2, the pre-exposing apparatus 17 is provided on the upstream side of the charging station, to reduce the surface potential level of the photosensitive drum 1 on the upstream side of the charging station, to 0 V. The pre-exposing apparatus 17 is turned on when controlling the charge bias.

In this embodiment, the time constant τ of the abnormal discharge current was roughly 1 μm. Therefore, the sampling frequency fs of the charge current measurement circuit 15 needed to be no less than 2 MHz (Nyquist rate). Thus, the sample frequency fs was set to 5 MHz: fs=5 MHz.

In order to confirm the occurrences of the current with a specific frequency, the through rate of the charge current measurement circuit 15 needed to be greater than a certain value. Thus, the through rate of the charge current measurement circuit 15 was set to 20 V/μs.

Figure 12:
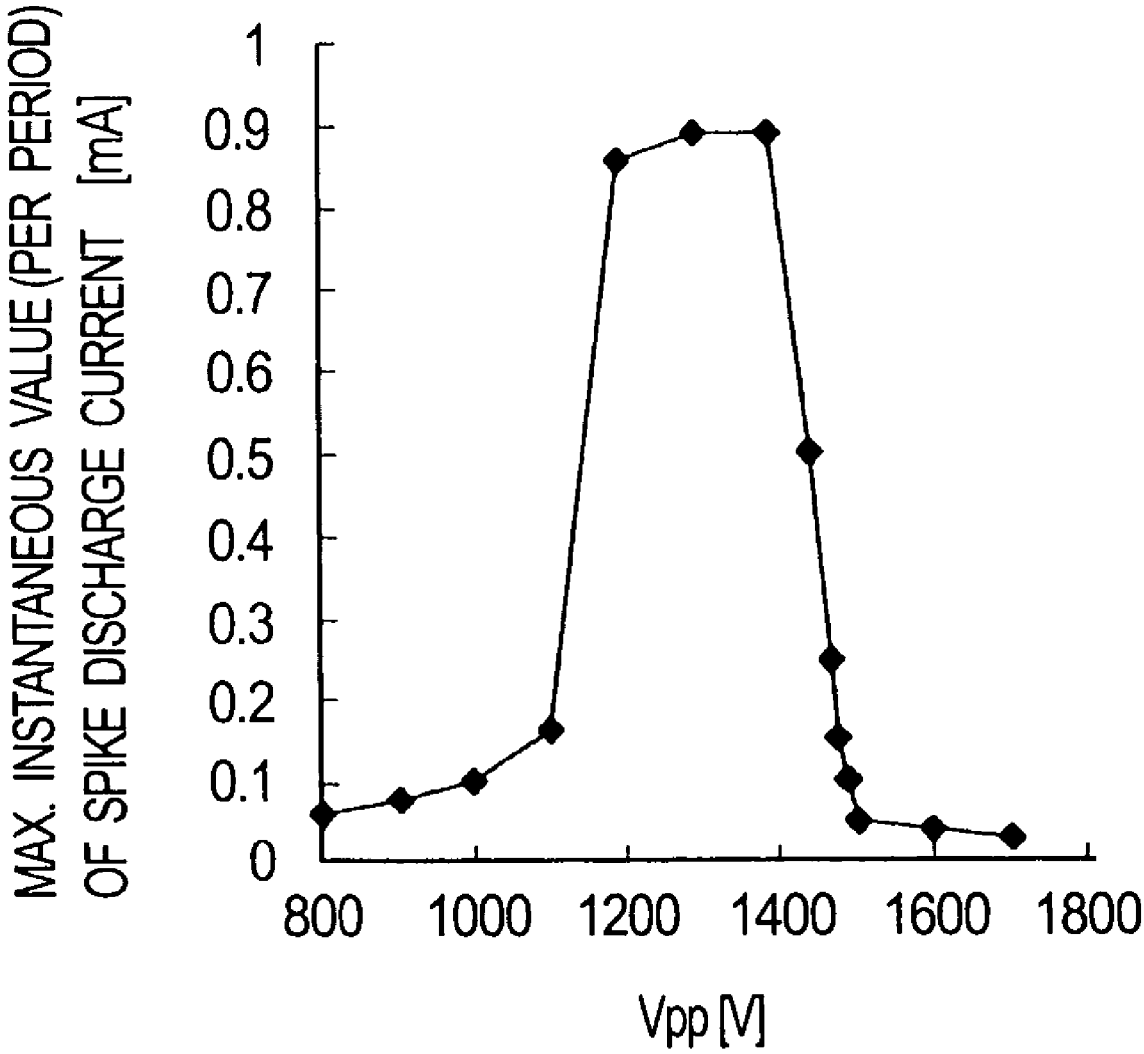
FIG. 12 is a graph showing the actually measured changes in the maximum instantaneous current of the abnormal discharge current, which occurred as the Vpp was varied.

FIG. 12 shows the changes in the maximum instantaneous current of the current with a specific frequency, which occurred as the Vpp of the AC voltage applied to the charge roller 2 was varied.

As described above, in this embodiment, the peripheral surface of the photosensitive drum 1 was uniformly charged as long as the surface potential level of the image bearing member on the upstream side of the charging station was 0 V, and also, as long as the maximum instantaneous current of the current with a specific frequency is no more than 0.2 mA when the DC voltage applied to the charging member was −600 V. Thus, it is reasonable to deduce that when the maximum instantaneous current of the current with a specific frequency is no more than 0.2 mA, the abnormal discharge current which effects image defects does not occur, and also, that when it is no less than 0.2 mA, the abnormal discharge current which effects image defects occurs. It is evident from FIG. 12 that when the Vpp of the AC voltage applied to the charging member was in the range of 1,200 V-1,440 V, the abnormal discharge current occurred.

In other words, there are an AC voltage level Vac1 (first AC voltage level), at which the abnormal discharge current, the maximum instantaneous current of which is greater than 0.2 mA, occurs, and an AC voltage level Vac2 (second AC voltage level), at which the abnormal discharge current, the maximum instantaneous current of which is no more than 0.2 mA, occurs. Thus, it may be deduced that as long as the AC voltage applied to the charge roller 2 is controlled with reference to this second AC voltage level Vac2 during image formation, the AC voltage will not have adverse effects on image quality.

Referring to FIGS. 8 and 9, which are synchronized in waveform phase, even if the two AC voltages applied to the charge roller 2 are different in peak-to-peak voltage Vpp, they are virtually the same in terms of the period in which the current with a specific frequency occurs. Thus, the phase detection circuit 16 is used to make it possible to measure the amount of the charge current only during a specific period within a single cycle of the AC voltage applied to the charge roller 2.

When the surface potential level of the photosensitive drum 1 is V1; the AC voltage applied to the charge roller 2 is V2; the charge bias, or the combination of AC voltage and DC voltage, applied to the charge roller 2 is V4; the DC voltage applied to the charge roller 2 is V3; and the voltage level at which the photosensitive drum 1 begins to be charged as the DC voltage applied to the charge roller 2 is gradually increased, is Vth, the V2 is made to coincide in phase with the V3, the amount of the charge current is measured while the value of the V2 is negative, and also, only during the period from the point roughly δt (which is 100 ms, in this embodiment) prior to the point t1 at which the value of |V1-V4| becomes equal to the value of Vth for the first time, to the point roughly δt after the point t1. By setting the δt to a value no more than ¼ the length of a single cycle of the applied AC voltage, the measurement accuracy can be improved while reducing the time necessary for the control.

With the employment of the above described setup, the noise current which unexpectedly occurs can be reduced in its effects, while improving the accuracy with which the amount of the current with a specific frequency is measured.

Next, the control circuit 14 shown in FIG. 3 will be described. The circuit 14*a* for extracting the current with a specific frequency has a function of extracting the current with a specific frequency from the charge current, based on the data carried by the charge current inputted from the charge current detection circuit 15.

The output signals from the charge current detection circuit 15 is divided into two sets. One set of signals is directly inputted into the input A of a difference comparison circuit, whereas the other set of signals is inputted into input B of the difference comparison circuit through a low frequency filter circuit which does not allow the current with a specific frequency to pass. With the provision of this arrangement, the portion of the current, the frequency of which is lower than the current with a specific frequency is eliminated. The circuit for extracting the current with a specific frequency may be different from that in this embodiment. In other words, it has only to be such a filtering circuit that is capable of eliminating, from the charge current obtained from the charge current measurement circuit 15, the portion of the current, the frequency of which corresponds to the frequency f1 of the AC voltage applied to the charge roller 2, while allowing the portion of the current with a specific frequence of ft to pass, based on the charge current data obtained from the current measurement circuit. Further, such a filtering circuit may comprise a plurality of subordinate filtering circuits.

The statistical computation circuit 14*b* has a function of outputting command signals for controlling the power source control circuit 14*c* after statistically processing the data carried by the current with a specific frequency, base on the current data inputted from the extraction circuit 14*a* for extracting the current with a specific frequency, using a predetermined method.

In this embodiment, the maximum instantaneous current is used as the control variable for confirming the occurrences of the abnormal discharge current. More specifically, the range in which the value of the Vpp of the AC voltage is no less than 2Vth, and the maximum instantaneous current of the current with a specific frequency is no more than 0.2 mA, is obtained, because in this embodiment, as long as the maximum instantaneous current of the current with a specific frequency is no more than 0.2 mA, that is, as long as the abnormal discharge current does not occur, the peripheral surface of the photosensitive drum 1 is uniformly charged, and therefore, the image defects attributable to the charging process do not occur.

In order to improve the accuracy with which the current with a specific frequency was measured, the measurement was repeated five times, that is, for a length of time equivalent to five cycles of the detected current, per AC voltage. The largest and smallest values obtained by the measurements were eliminated, and then, the average value of the rest was calculated.

When the properties of the AC voltage are varied to detect the occurrences of the current with a specific frequency, the difference, in the peak-to-peak voltage of the AC voltage, between any two steps, that is, the amount by which the peak-to-peak voltage of the AC voltage is to be changed between any two steps in the charge bias control process, is variable, and the varying of the Vpp of the AC voltage is stopped as the amount by which the peak-to-peak voltage of the AC voltage is to be changed between any two sequential steps becomes smaller than a predetermined threshold value. Described next will be the method for obtaining this threshold value.

The lengths of time it takes for the photosensitive drum 1 and charge roller 2 to rotate once are 0.942 second and 0.377 second, respectively. In the following description, Vpp9 is the peak-to-peak voltage of a given AC voltage which generates the abnormal discharge current, the value of which is no less than 0.2 mA, per oscillatory cycle of the detected charge current, when the amount of the charge current is measured for one second which is longer than the lengths of the rotational cycles of the photosensitive drum and charge roller 2. Vpp10 is the peak-to-peak voltage of the AC voltage which does not generate the abnormal discharge current, the maximum instantaneous current of which is no less than 0.2 mA, during the period in which the measurements are made. Vpp11 is the maximum peak-to-peak voltage of the AC voltage which does not always generate the abnormal discharge current, the magnitude of the current with a specific frequency of which is no less than 0.2 mA, per oscillatory cycle of the charge current, during the measurement period, but generates the abnormal discharge current, the magnitude of the current with a specific frequency of which is no less than 0.2 mA during some of the oscillatory cycles during the measurement period. Further, it is assumed that Vpp9 <Vpp11 <Vpp10 is satisfied.

Under this condition, the minimum amount δVmin by which the Vpp of the AC voltage is to be varied in order to control the charging process must be no more than |Vpp10-Vpp11|, because as the photosensitive drum 1 and charge roller 2 are rotated, the conditions under which the charging nip is formed vary, and therefore, the conditions under which the abnormal discharge current occurs change. In this embodiment, |Vpp10-Vpp11|=30 V. Thus, in order to precisely determine the minimum value for the Vpp of the AC voltage of the charge bias, the minimum amount (δVmin) of voltage by which the Vpp of the AC voltage was to be altered between any sequential two steps in the charge bias control process was set to 10 V.

Described below is the method for obtaining the proper peak-to-peak voltage value for the AC voltage to be used as a part of the charge bias, by varying the AC voltage in peak-to-peak voltage. It is assumed that the peak-to-peak voltage of the AC voltage applied to the charging member is Vpp; the minimum peak-to-peak voltage value which generates the abnormal discharge current is Vpp1; the maximum value of the peak-to-peak voltage which generates the abnormal discharge current is Vpp2; and the minimum value of |Vpp1-Vpp2| regardless of the individual component differences, ambience, manner of usage is δW1.

The difference between a charge roller from one lot and a charge roller from another lot, difference between an ambience in which temperature and relative humidity are 32.5° C. and 80%, respectively, and an ambience in which temperature and relative humidity are 15° C. and 10%, respectively, and the difference between the beginning of the first time usage and during the latter part of its service life, were measured, and δW1 was obtained.

Figure 13:
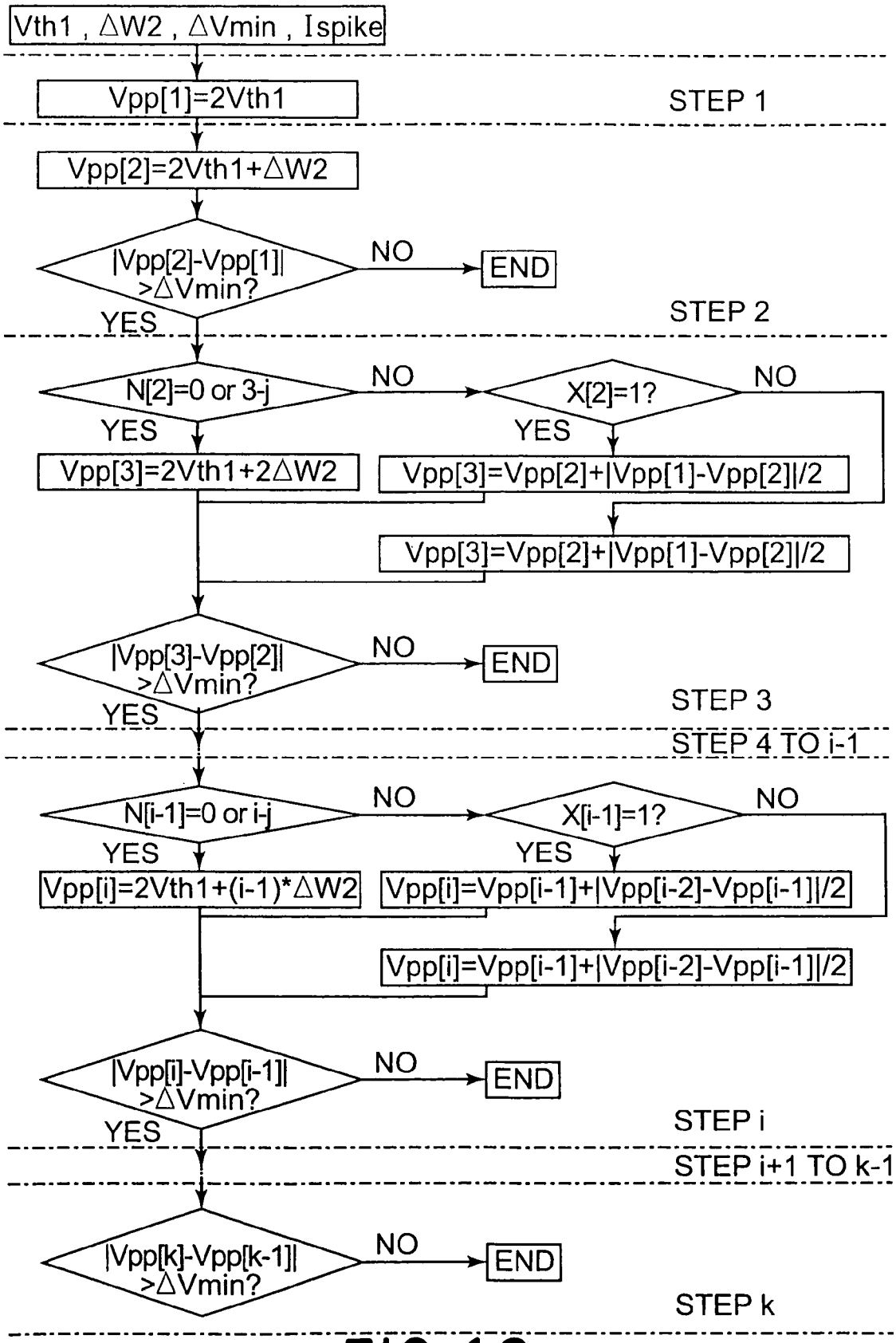
FIG. 13 is a flowchart for obtaining the value of the peak-to-peak voltage Vpp of the charge bias.

The proper value for the Vpp of the AC voltage used as a part of the charge bias was obtained following the flowchart in FIG. 13, using δW2, which satisfies an inequality: δW1>δW2.

The amount by which the Vpp of the AC voltage as a part of the bias applied to the charging member was varied was:

$$\delta W2\times 2^{-n}(n=0,1,2,3,\ldots)$$

Described below is the details of the flowchart followed to obtain the minimum peak-to-peak voltage Vpp1 at which the amount of the maximum instantaneous current of the abnormal discharge current was always no more than a predetermined value Ispike, when a specific photosensitive drum 1, charge roller 2, and electrophotographic printer was in use.

FIG. 13 is a flowchart of the process for determining the proper Vpp for the AC voltage of the charge bias. If the photosensitive drum 1, charge roller 2, and/or main assembly of an electrophotographic apparatus is switched, first, the average value Vth1 of the Vth is obtained in advance under the H/H condition, because when the Vpp of the AC voltage is no less than 2Vth, there are ranges in which the abnormal discharge current occurs regardless of the condition under which the photosensitive drum 1 is charged.

The obtained average value is stored in the statistical computation circuit 14*b* of the charge bias control circuit 14.

Next, δW2, that is, the factor which determines the amount by which the Vpp is to be varied, δVmin, that is, the minimum amount by which the Vpp is to be varied; and Ispike, that is, the value used for detecting the occurrences or nonoccurrence of the maximum instantaneous current of the abnormal discharge current, are set.

In each of the following steps in which the occurrences or nonoccurrence of the abnormal discharge current is detected while varying the Vpp, it is determined whether or not the average value of the maximum instantaneous current of the abnormal discharge current exceeds Ispike. If it exceeds a value of 1 is outputted, whereas, if it does not exceed, a value of 0 is outputted.

In the following description of the flowchart, Vpp[i] is the value of the Vpp of the AC voltage detected in the i-th step; N[i] is the number of 1s outputted before the end of the i-th step; X[i] is the value of the output in the i-th step; and j is ordinal number of the step in which 1 is outputted for the first time.

The Vpp is varied according to the following logical formula:

In Step 1 (i=1), Vpp[1]=2Vth1

In Step 2 (i=2), Vpp[2]=2Vth1+δW2

In Step 3 and thereafter, (i≧3), if N[i−1]=0, Vpp[i]=2Vth1+(i−1)*δW2 if N[i−1]=i−j, Vpp[i]=2Vth1+(i−1)*δW2 if 0<[N[i−1]<i−j, and X[i−1]=0 Vpp[i]=Vpp[i−1]−|Vpp[i−2]−Vpp[i−1]|/2 if 0<[N[i−1]<i−j, and X[i−1]=1 Vpp[i]=Vpp[i−1]+|Vpp[i−2]−Vpp[i−1]|/2.

After the completion of each step, it is determined which is larger, |Vpp[i−1]−Vpp[i]|, that is, the amount by which the Vpp was varied, and δVmin, that is, the minimum amount by which the Vpp is varied. If the former is greater, the next step is taken, whereas if the former is smaller, the Vpp is varied, ending the charge bias control process for detecting the abnormal discharge current.

Then, the value of the Vpp in the step in which the last output value became 0 at the end of the charge bias control process, is used as the minimum peak-to-peak voltage Vpp1 for the AC voltage which can be applied to the charging member.

Figure 14:
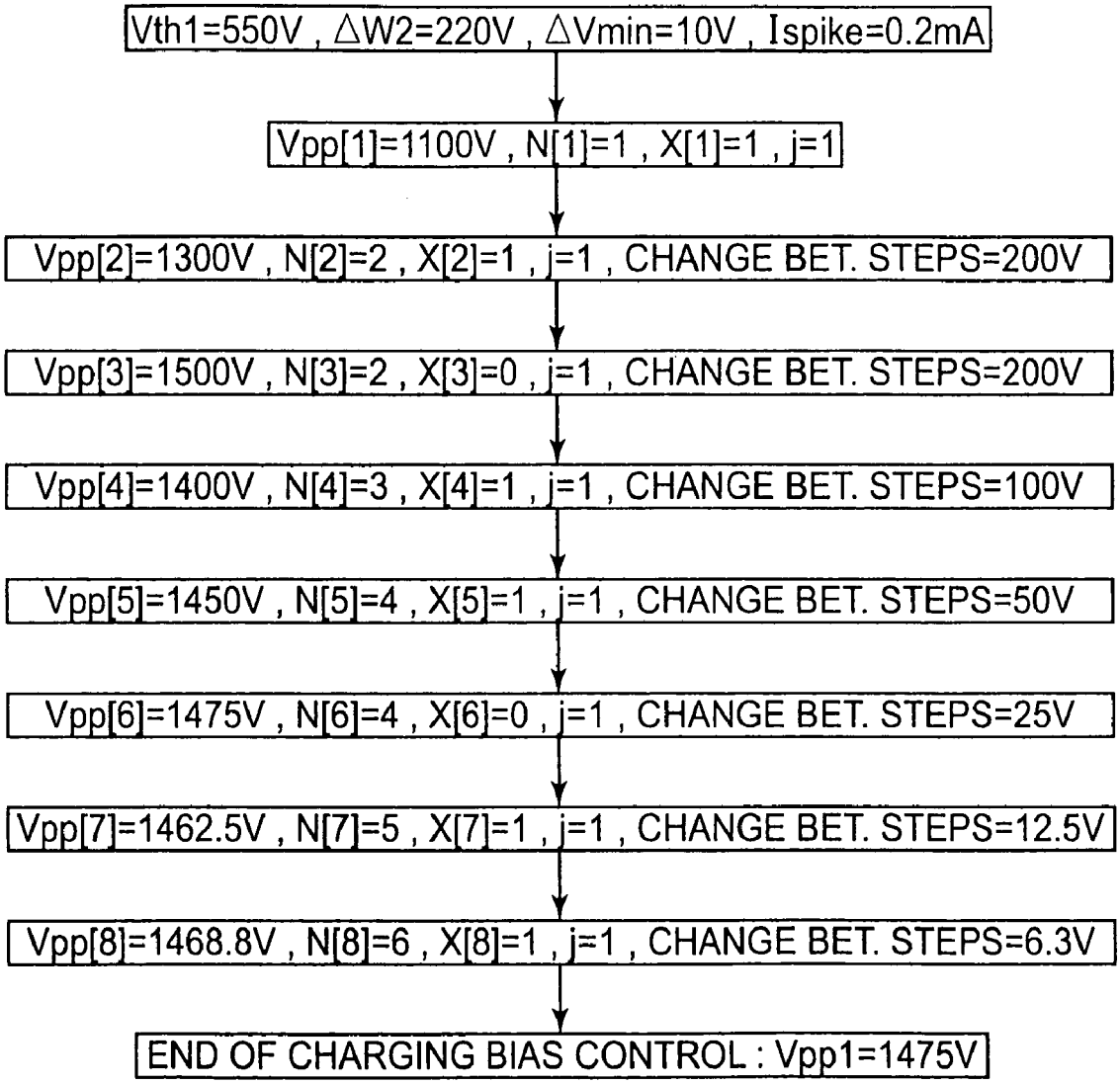
FIG. 14 is a flowchart showing the process carried out to obtain the peak-to-peak voltage Vpp of the charge bias in the first embodiment of the present invention.

The following is an example of the charge bias control process which was actually carried out. In this case, δW1=250V; Vth1=550 V; δVmin=10 V; Ispike=0.2 mA. For measurement accuracy, &DW2 was set to 200 V: δW2=200 V. Under this condition, the value of the minimum Vpp which kept the maximum instantaneous current of the current with a specific frequency at level no greater than 0.2 mA for a period substantially longer than the time it takes for the charge roller 2 to rotate once was 1,470.2 V. Thus, Vpp1=1,475.0 V as shown in FIG. 14. The minimum unit of the Vpp was 0.1 V.

Ordinarily, the value obtained by adding a predetermined offset voltage of δVpp for reliably charging the photosensitive drum 1, to the Vpp1 obtained through the above described charge bias control process, is used as the value for the peak-to-peak voltage of the AC voltage to be actually applied to the charging member. If two or more AC voltages which do not generate the abnormal discharge current are obtained, the offset voltage δVpp may be set to a value greater than the difference between the largest (Vppmax) and smallest (Vppmin) of the peak-to-peak voltages of the plurality of these AC voltages, for the following reasons.

That is, under certain rotational conditions of the photosensitive drum 1 and charge roller 2, the maximum instantaneous current of the current with a specific frequency fluctuates around 0.2 mA, which results in measurement errors. However, with the addition of a proper offset voltage δVpp, the charging errors do not occur even for a period substantially longer than the time it takes for the charge roller 2 to rotate once.

In the case of the above described example, the offset voltage δVpp was set to 20 V (δVpp=20 V), and the peak-to-peak voltage of the AC voltage to be applied to the charging member was set to 1,490 V. As a result, images of good quality were obtained, proving that the photosensitive drum 1 was uniformly charged.

As for the time it took to carry out the process from the first step to the last step, it equals the length of a single oscillatory cycle of the charge current ×5 (measurement count) ×8 (number of steps). Therefore, it was 40 milliseconds.

The Vth1 does not need to be exact. Therefore, the Vth does not need to be frequently reset. In other words, Vth1 may be obtained under the conditions under which specific photosensitive drum, charge roller, and electrophotographic printer main assembly are used.

Further, δW2 does not need to be exact. In other words, a value deduced based on experience, that is, a value deduced from the record of the previous occurrences of the abnormal discharge current, may be used, as long as the value is smaller than the value of the Vpp of the AC voltage which generates the abnormal discharge current.

Therefore, as long as the values used for the charge bias control are set, the length of time necessary to determine the charge bias is only the length of time necessary to find out the conditions under which the abnormal discharge current occurs, by varying the Vpp of the Ac voltage. In other words, the charge bias can be controlled in an extremely short length of time.

By using the above described method to determine the AC voltage to be applied to the charge roller, it is possible to find the optimal AC voltage which minimize discharge while preventing the unsatisfactory charging of the photosensitive drum, regardless of the changes in the electrical resistances, structures, surface properties, shapes, etc., of the charge roller and photosensitive drum. When the above described method was used, such an AC voltage that minimized discharge while preventing the unsatisfactory charging of the photosensitive drum was obtained even toward the end of the service lives of the charge roller and/or photosensitive drum, in spite of the contamination of the charge roller, the length of time electricity was flowed through the charge roller and photosensitive drum, and the frictional wear of the surface layer of the photosensitive drum.

In the case of the charge control process in accordance with the prior art, in order to keep the amount of the alternating discharge current, or the amount proportional thereto, at a predetermined value, the values used for the charge bias control were set to appropriate for a typical charge roller. Thus, the these values were sometimes too high or too low, when the minimum necessary amount of the alternating discharge current fluctuated due to the difference among charge rollers attributable to the difference in production lot, for example.

Also in the case of the charge control process in accordance with the prior art, in order to reliably charge an object, the amount of the alternating discharge current necessary to charge the object was sometimes set to a value higher than the minimum amount necessary, in consideration of the variance among charge rollers.

In comparison, this embodiment made it possible to find such AC voltage that generates only the smallest amount of discharge current necessary for the charging of the photosensitive drum 1 while preventing the unsatisfactory charging of the charge roller, regardless of the variance among charging members.

Also in the case of the charge control process in accordance with the prior art, the amount of the alternating discharge current was set to a small value relative to the overall alternating discharge current value, in order to minimize the amount of the alternating discharge current. Therefore, the amount of the measurement error was large. Thus, in order to prevent the unsatisfactory charging of an object, that is, in order to uniformly charge the object, the amount of the alternating discharge current had to be set to a value slightly larger than necessary. In comparison, in the case of this embodiment, the occurrence of the abnormal discharge current is controlled based on the current with a specific frequency, the value of the maximum instantaneous current of which is smaller than the effective value of the alternating current. Therefore, it is possible to obtain such AC voltage that generates only the minimum amount of discharge necessary to precisely charge an object, that is, without charging errors.

Also in the case of the control in accordance with the prior art, in order to reduce measurement errors, the averaging process was employed. This process, however, required a long time in order to improve the accuracy with which the amount of the abnormal discharge current was measured. In comparison, in the case of the control in this embodiment, the control process can be completed in a very short time as shown in FIG. 14.

Also in the case of the control in accordance with the prior art, the amount of the alternating discharge current was controlled. Therefore, transient abnormal discharge current, which resulted in the local charging error, could not be detected. Therefore, such image defects as grainy areas or horizontal streaks attributable to the local charging errors sometimes occurred. In comparison, in the case of the control in accordance with the present invention, control is executed based on the occurrence or nonoccurrence of the abnormal discharge current which results in the local charging errors. Therefore, the occurrences of such image defects as grainy areas or horizontal streaks attributable to the local charging errors can be prevented. Further, the control in accordance with the present invention makes it possible to detect the occurrence of the abnormal discharge current no matter where it is occurring in terms of the lengthwise direction of the photosensitive drum (charge roller). Therefore, the control in accordance with the present invention makes it possible to prevent the occurrences of such image defects as grainy areas and/or horizontal streaks attributable to the local charging errors, across the entirety of the lengthwise direction of the photosensitive drum (charge roller).

C-3) Supplements to Embodiment 1

In this embodiment, the charging apparatus is provided with the charge current measurement circuit 15, but, it is not provided with a circuit for integrating the charge current. However, the charging apparatus may be provided with a charge current integration circuit, which outputs the effective value of the alternating current, or the like values.

Referring to FIG. 3, in this embodiment, the charge current measurement circuit 15 is placed between the substrate of the photosensitive drum 1 and ground. However, this placement is not intended to limit the point at which the charge current is measured. In other words, as long as the charge current is accurately measured, the measurement point does not matter. For example, the charge current measurement circuit 15 may be placed between the charge bias power source 11 and charge roller 2. Further, the amount of the load used for charge current measurement is optional, provided that it is sufficiently small relative to the electrical resistance of the charge roller 2.

The DC voltage of the charge bias applied to the charge roller 2, and the frequency and waveform of the AC voltage of the charge bias applied to the charge roller 2, do not need to be limited to those described above.

In this embodiment, the frequency was set to 1 kHz. However, it may be changed according to the process speed (peripheral velocity) of the photosensitive drum 1, in order to assure that the photosensitive drum is uniformly charged.

Also in this embodiment, the AC voltage which was sinusoidal in waveform was used. However, the waveform of the AC voltage may be different from that in this embodiment. For example, it may be rectangular, triangular, sawtoothed, pulsatory, etc.

Also in this embodiment, the value of the peak-to-peak voltage of the AC voltage is used as the factor to be varied to find the optimal charge bias. However, the factor(s) to be varied does not need to be limited to the peak-to-peak voltage. For example, the frequency or waveform of the AC voltage may be varied.

Provided that the properties of the photosensitive drum 1 and charge roller 2 are not drastically affected by the environmental condition, for example, whether they are used in the H/H environment or the L/L environment, a predetermined value may be substituted for the value of the Vth at which the discharge to the photosensitive drum 1 begins as the DC voltage applied to the charge roller 2 is gradually increased.

Further, the charging apparatus may be provided with a means for determining the value of the Vth. For example, it may be provided with an apparatus capable of measuring the direct current induced by the application of the DC voltage.

Such an apparatus can determine the value of the Vth, because the amount of the direct charge current begins to suddenly increase after the discharge to the photosensitive drum begins as the DC voltage applied to the charge roller is gradually increased.

Also in this embodiment, the startup time of the abnormal discharge current was roughly 0.3 μs. It has been known from experience that the length of the startup time of the abnormal discharge current is determined by the overall structure and condition of the charging nip. When various objects to be charged, and charging members, which were different in laminar structure and resistance distribution, were measured in the length of the startup time of abnormal discharge current, it became evident that the following mathematical formula was satisfied:

$$\tau \leqq 100\ \mu s, \text{ or } \tau \leqq 1/(10 \cdot f)$$

τ: length of startup time f: frequency of AC voltage applied to charging member.

In terms of the frequency:

$$ft \geqq 10{,}000\ (Hz), \text{ or } ft \geqq 10 \cdot f$$

ft: frequency of abnormal discharge current.

Generally, in order to capture the signals with a frequency of f Hz, sampling must be done where Nyquist rate is no less than 2 fHz. Thus, when the sampling frequency at which the charge current is measured is fs, and the time constant of the abnormal discharge current is τ, fs must be set so that an inequality: $fs>2/\tau$ is satisfied. Thus, in terms of frequency, fs must be set so that an inequality: fs>2 ft, is satisfied, wherein ft is frequency of the abnormal discharge current.

In this embodiment, the time constant τ of the abnormal discharge current is roughly 1 μs. Therefore, the sampling frequency fs of the charge current measurement circuit is set to a value no less than 2 MHz in Nyquist rate, more specifically, 5 MHz (fs=5 MHz).

It has been known from experience that the time constant τ is determined by the charge bias applied to a charging member and the overall structure of the charging nip. In particular, the effects of the resistance structures, surface properties, and shapes of the charging member and the object to be charged, are large. Thus, a plurality of charging members and a plurality of objects to be charged, which were different in charge bias, laminar structure, and resistance distribution were measured in the time constant τ of the abnormal discharge current. As a result, it became evident that their time constants were in the range of 0.01 μs-100 μs, although most them were in the range of 0.1 μs-100 μs. Therefore, the sampling frequency needs to be no less than 0.02 MHz.

The effects of the changes in such environmental factors as temperature and humidity, and the changes in the surface contamination of the charge roller, upon the time constant τ is small.

On the basis of the above described facts, the optimal sampling frequency determined based on the measured time constant τ of the abnormal discharge current which occurs when the charge bias and the overall structure of the charging nip are standard may be used from the beginning of the service lives of the photosensitive drum and charge roller to the end. Further, the sampling frequency for the charge current measurement circuit may be determined in accordance with the value of the time constant τ of the abnormal discharge current generated by each of the combinations of the photosensitive drum and charge roller different in the overall structure of the charging nip. Further, the sampling frequency for the charge current measurement circuit may be set to a value which is sufficiently fast, even if the difference in charge bias, and the individual differences among the objects to be charged and charging members are taken into consideration.

In order to enable the charge current measurement circuit to confirm the occurrences of the abnormal charge current, the through rate of the charge current measurement circuit needs to be higher than a predetermined value. In this embodiment, the through rate of the charge current measurement circuit 15 was 20 V/μs. The through rate of a charge current measurement circuit does not need to be limited to the above value; it may be altered in accordance with the time constant τ of the abnormal discharge current.

For example, when the time constant of the abnormal discharge current is τ, and the through rate of the charge current measurement circuit is T, the condition under which the abnormal discharge current is occurring can be confirmed, as long as the through rate satisfies an inequality: $T \times \tau \geqq 1$. When the frequency of the abnormal discharge current is ft, the through rate T must satisfy an inequality: $T/ft \geqq 1$. In this case, the time constant τ of the abnormal discharge current is between 0.01 μs and 100 μs. Therefore, the through rate must be no less than 10 V/ms.

As long as it is possible to confirm whether or not the amount of the maximum instantaneous current of the abnormal discharge current is no more than a predetermined value, the through rate may be of any value.

However, the through rate of the charge current measurement circuit affects the maximum instantaneous current of the abnormal discharge current, which allows an object to be uniformly charged, and which does not affect the level of quality at which an image is formed. When the time constant τ of the abnormal discharge current is 1 μs, the amount of the maximum instantaneous current of the abnormal discharge current which does not affect the image quality when the through rate is sufficiently fast is no more than 0.2 mA. Therefore, when using a charge current measurement current with a slow through rate, an adjustment should be made in accordance with this value.

In other words, it is necessary to find out the value to which the amount of the maximum instantaneous current changes as such abnormal discharge current that is 1 μs in time constant and 0.2 mA in maximum instantaneous current is inputted into the charge current measurement circuit.

If the various charge voltages are synchronized with the waveform of the AC voltage, the period in which the abnormal discharge current occurs corresponds to the same section of the waveform of the AC voltage. Thus, by limiting the period in which the charge current is measured to a specific period which includes the period in which the abnormal discharge current occurs, the abnormal discharge current can be measured with a higher level of accuracy.

The method for measuring the abnormal discharge current does not need to be limited to the method in this embodiment; it is optional as long as it limits the period in which the charge current is measured to the period which includes the period in which the abnormal discharge current occurs.

Further, the choice of the circuit for extracting the abnormal discharge current is optional; any circuit may be employed as long as it can extract the abnormal discharge current from the charge current. The following are the examples of such a circuit.

In one of the examples, the output signals from the charge current measurement circuit are divided into two sets of signals. One set of the signals is inputted into a low-frequency pass filter circuit A which allows the abnormal discharge current to pass in such a manner that does not allow the current component higher in frequency than the abnormal discharge current to pass, and then, is inputted into the input A of a difference comparison circuit, whereas the other set of signals is passed through a low-frequency pass filter circuit B which does not pass the abnormal discharge current, and then, is inputted into the input B of the difference comparison circuit. With this process, the high-frequency noises in the output signals from the charge current measurement circuit can be eliminated.

In the next example, a charge current averaging apparatus is provided, which synchronizes the output signals from the charge current measurement circuit with the charge bias, that is, the combination of AC and DC voltages, applied to the charge roller, and averages the signals for each cycle. The output signals from the charge current measurement circuit are inputted into the input A of the difference comparison circuit, and the output signals from the charge current averaging apparatus are inputted into the input B of the difference comparison circuit. With this process, the abnormal discharge current can be extracted from the charge current. The charging apparatus may be structured to apply an optimal voltage to the charge roller with the use of the power control circuit so that the amount of the abnormal discharge current will remain smaller than a predetermined value. In such a case, a frequency based filtering circuit is unnecessary.

Incidentally, while the photosensitive drum and charge roller are rotated, alternating current changes. Therefore, it is desired that control is executed to keep the current from the above described difference comparison circuit, within a predetermined threshold range.

As described above, in this embodiment, the maximum instantaneous current is used as the control variable for predicting the occurrence of the abnormal discharge current. When the difference (−600 V) between the surface potential level of the photosensitive drum on the upstream side of the charging station, and the potential level of the DC voltage applied to the charge roller is large, and therefore, the maximum instantaneous current, the value of which is roughly the same, or greater than, the effective value of the AC voltage, occurs, the threshold of the above described circuit is set to a value equal to, or greater than, the amount by which the effective value of the alternating current changes as the photosensitive drum and charge roller are rotated. With this arrangement, the maximum instantaneous current of the abnormal discharge current can be measured at a high level of accuracy.

In this embodiment, the maximum instantaneous current is used as the control variable for predicting the occurrences of the abnormal discharge current which affects image formation. However, the choice of the control variable is optional; it may be any of various control variable, as long as the variable makes it possible to predict the occurrences of the abnormal discharge current. For example, it may be the number of the occurrences of the abnormal discharge current greater in maximum instantaneous current than a predetermined threshold value, length of the time the abnormal discharge current greater in maximum instantaneous current than a predetermined threshold value lasts, integrated value (total amount of charge) of the abnormal discharge current over the period of the elapsed time in which the value of the abnormal discharge current is greater than a predetermined threshold value, standard deviation of the alternating discharge current within a predetermined period in which the alternating discharge current occurs, etc.

Figure 15:
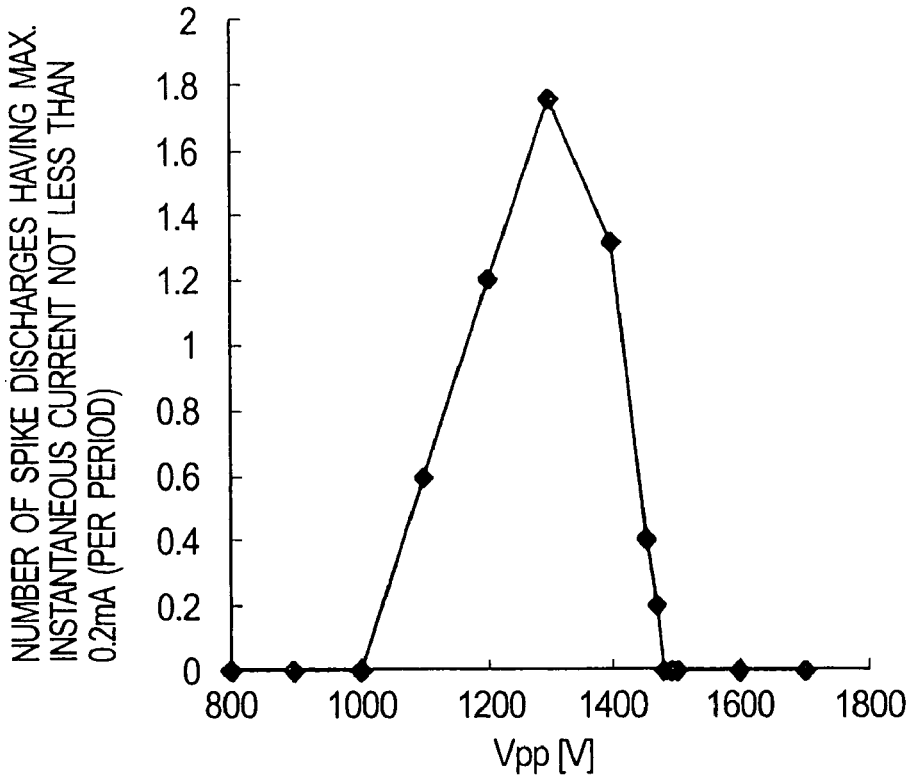
FIG. 15 is a graph showing the changes, in the actual number of the occurrences of the abnormal discharge current, the maximum instantaneous current of which was greater than a predetermined threshold value, which occurred as the Vpp was varied.

FIG. 15 shows the changes in the actual number of the occurrences of the abnormal discharge current, the maximum instantaneous current of which was no less than 0.2 mA, which occurred as the Vpp was varied.

Figure 16:
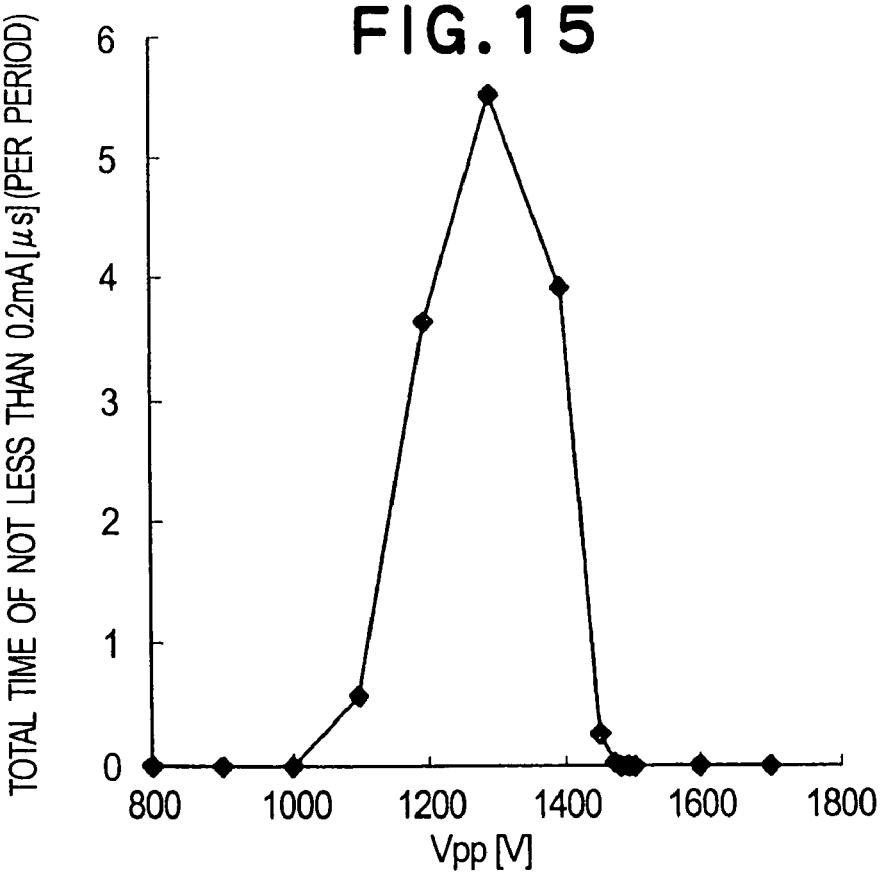
FIG. 16 is a graph showing the changes, in the actual length of time such abnormal discharge current that was greater than a predetermined threshold value flowed, which occurred as the Vpp was varied.

FIG. 16 shows the changes in the actual length of time the abnormal discharge current, the maximum instantaneous current of which was no less than 0.2 mA flowed, which occurred as the Vpp was varied.

Figure 17:
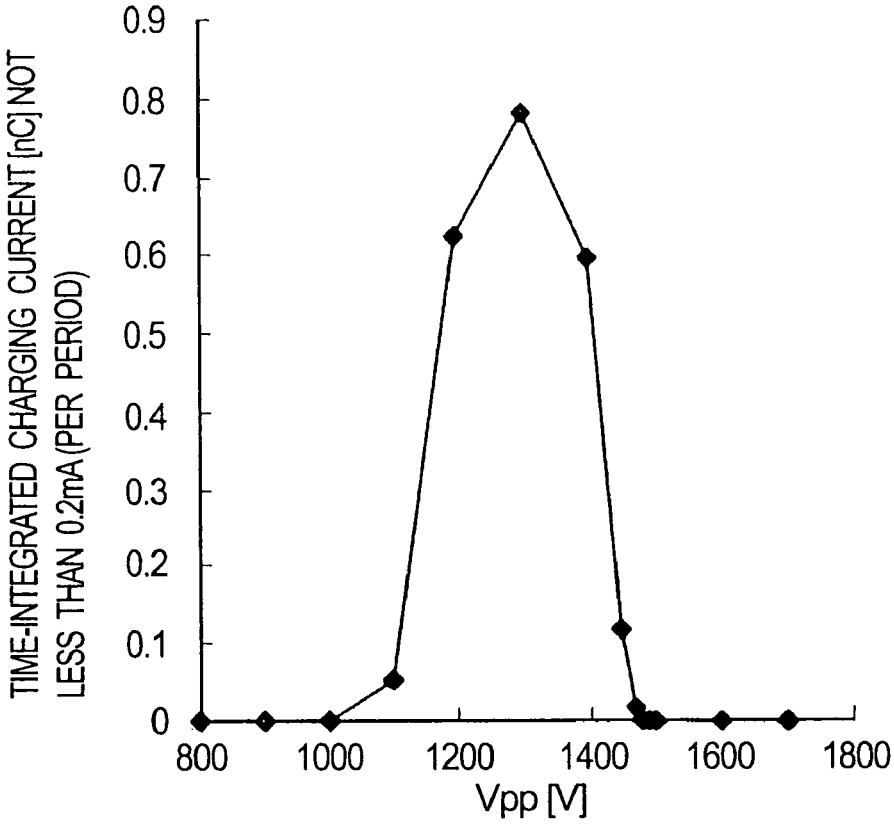
FIG. 17 is a graph showing the changes, in the actual value obtained by integrating, over the elapsed time, the amount of the abnormal discharge current greater than a predetermined threshold value, which occurred as the Vpp was varied.

FIG. 17 shows the changes in the integration, over elapsed time, of the abnormal discharge current, the maximum instantaneous current of which was no less than 0.2 mA, which occurred as the Vpp was varied.

Figure 18:
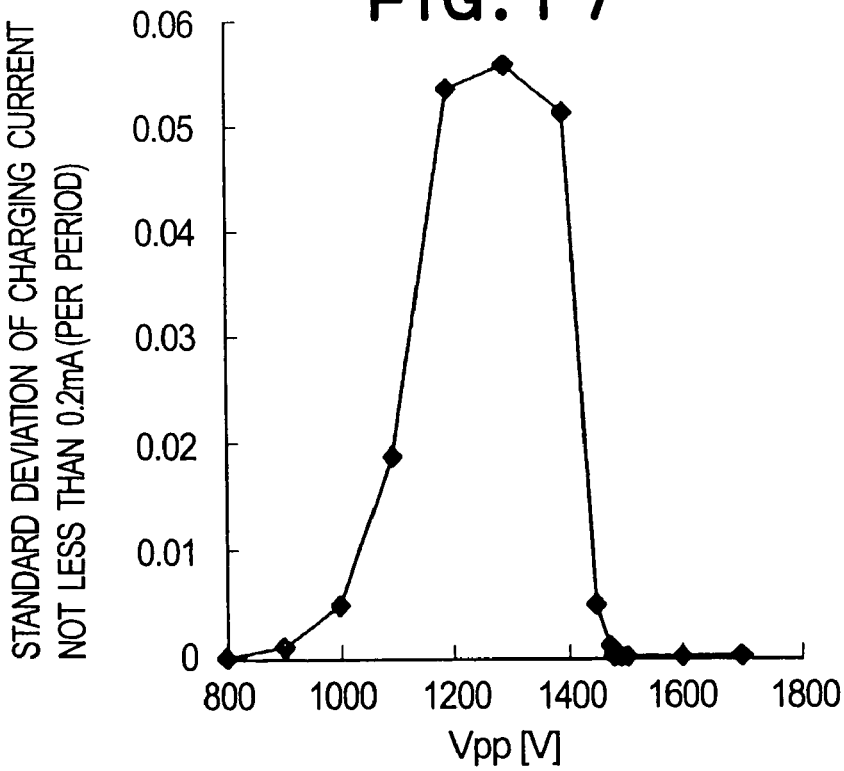
FIG. 18 is a graph showing the changes, in the actual standard deviation of the alternating discharge current, within a predetermined length time in the period in which the alternating discharge current occurred, which occurred as the Vpp was varied.

FIG. 18 shows the changes in the standard deviation of the alternating discharge current, within a predetermined length of time in the period in which alternating discharge current occurred, which occurred as the Vpp was varied.

In order to obtain the values in FIGS. 15-18, the alternating discharge current was measured five time, more specifically, once per oscillatory cycle of the AC voltage, for a length of time equivalent to five oscillatory cycles of the AC voltage, and the average value thereof was calculated by eliminating the largest and smallest values.

As will be evident from these graphs, the condition under which the abnormal discharge current occurs can be deduced as can the condition under which the maximum instantaneous current occurs be deduced. Thus, the number of the occurrences of the abnormal discharge current, length of the occurrences thereof, and integrated value of the abnormal discharge current over elapsed time, etc., can be used in place of the maximum instantaneous current.

In this embodiment, in order to improve the level of accuracy at which the abnormal discharge current is measured, the abnormal discharge current was measured five times, that is, once per oscillatory cycle, for a length of time equivalent to the five oscillatory cycles of the AC voltage, per AC voltages. Then, the average value was obtained by eliminating the largest and smallest values. However, the measuring method, number of measurements, method for statistics, do not need to be limited to those described above. For example, the abnormal alternating current may be measured only once per plurality of oscillatory cycles, and the average value may be obtained using all the values obtained by the measurements. In other words, any method may be employed, as long as measurement is made at a level of accuracy sufficient to control the charge bias, regardless of the fact that the condition under which the abnormal discharge current occurs varies from one oscillatory cycle to another.

Also in this embodiment, as the amount by which the Vpp was to be varied falls below a predetermined threshold value while varying the AC voltage, the charge bias control was ceased. The control for determining the upper limit of this threshold does not need to be always executed per charge control, because the changes in the top limit of the threshold is not significantly affected by the changes in the condition under which the usage occurs or the length of usage. Further, the top limit of the threshold may be set based on experience, instead of using the control in this embodiment.

In this embodiment, twice the Vth in H/H environment was used as the initial amount by which the Vpp was varied. However, the initial amount does not need to be limited to this value. For example, twice the Vth in L/L environment may be used as the initial value. Such an example will be described next.

As the photosensitive drum 1, charge roller 2, and/or main assembly of an electrophotographic image forming apparatus, are replaced, the average value Vth2 of the Vth is obtained in advance in the L/L environment, because regardless of charging condition, there are always areas in which the abnormal discharge current occurs when the Vpp is no more than 2Vth2.

The average value is stored in the statistical process circuit 14*b* of the charge bias control circuit 14.

Next, the factor δW2 for determining the amount by which the Vpp is to be changed between any sequential two steps in the charge bias control process, minimum amount δVmin by which the Vpp is to be changed between any sequential two steps in the charge bias control process, and the threshold value Ispike, are set.

In each of the steps which are different in the Vpp, and in which the abnormal discharge current is measured, it is determined whether or not the average value of the maximum instantaneous current of the abnormal discharge current exceeds the Ispike. If it exceeds, a value of 1 is outputted, whereas if it does not exceed, a value of 0 is outputted.

In the following, Vpp[i] is the value of the Vpp of the AC voltage measured in the i-th step; N[i] is the number of Is outputted before the end of the i-th step; X[i] is the value of the output in the i-th step; and j is ordinal number of the step in which 1 is outputted for the first time.

The Vpp is varied according to the following logical formula:

In Step 1 (i=1), Vpp[1]=2Vth2

In Step 2 (i=2), Vpp[2]=2Vth2−δW2

In Step 3 and thereafter, (i≧3), if N[i−1]=0, Vpp[i]=2Vth2−(i−1)*δW2 if N[i−1]=i−j, Vpp[i]=2Vth2−(i−1)*δW2 if 0<[N[i−1]<i−j, and X[i−1]=1 Vpp[i]=Vpp[i−1]−|Vpp[i−2]−Vpp[i−1]|/2 if 0<[N[i−1]<i−j, and X[i−1]=1 Vpp[i]=Vpp[i−1]+|Vpp[i−2]−Vpp[i−1]|/2.

After the completion of each step, it is determined which is larger, |Vpp[i−1]−Vpp[i]|, that is, the amount by which the Vpp was varied between any sequential two steps, and δVmin, that is, the minimum amount by which the Vpp was varied between any sequential two steps. If the former is greater, the next step is taken, whereas if the former is smaller, the Vpp is varied, ending the charge bias control process for measuring the abnormal discharge current by varying the Vpp.

When ending the charge bias control process, the value of the Vpp in the last step in which the last output value became 0 is employed as the minimum peak-to-peak value Vpp1 for the AC voltage to be applied to the charging member.

In this embodiment, the value usable as the minimum value for the Vpp of the AC voltage is obtained by varying the Vpp as depicted by the charge bias control process in FIG. 13. However, the method for determining the AC voltage to be applied to the charging member does not need to be limited to the above described method in this embodiment. In other words, any method may be employed as long as the method can determine the minimum Vpp, that is, the Vpp which generates the minimum mount of discharge that does not result in the unsatisfactory charging of a charge roller.

The charge bias applied to a charging member, overall structure and condition of the charge nip, structure and condition of an electrophotographic apparatus, hardly affects the maximum instantaneous current of the abnormal discharge current, which does not cause the improper charging of a photosensitive drum. However, the maximum instantaneous current of the abnormal discharge current, which does not cause the improper charging of a photosensitive drum, may be individually set according to each of the various charging conditions.

Normally, the above described charge bias control process, in this embodiment, for finding out an optimal AC voltage as the AC voltage to be applied to a charging member, is carried out during the pre-rotation period, for example, during the first rotation after the starting of the charging process, or during one of the operational periods in which no image is formed, for example, during the paper intervals in an operation in which a plurality of copies are outputted. However, in order to prevent the noises generated by the high voltage power sources other than the power source for a charging apparatus, for example, the development power source, transfer power source, etc., from affecting the electric circuit for determining the optimal AC voltage to be applied to a charge roller, the charge bias control process is desired to be carried out while such high voltage power sources as the development power source, transfer power source, etc., are not operating. However, the period in which the charge bias control process is carried out does not need to be limited to the periods in which no image is formed. In other words, it may be carried out while an image is being formed.

Regarding such properties as shape, resistance, structure, etc., of a charging member, the charge roller 2 in this embodiment is provided with three functional layers. However, the properties of a charging member do not need to be limited to those in this embodiment.

For example, an electrically conductive laminar blade or an electrically conductive brush may be employed as a charge member.

In fact, whether or not the above described conditions are met is related to the process speed of an electrophotographic apparatus, and the size of the upstream and downstream areas of the charging station, in which discharge occurs.

In this embodiment, the charging member was in contact with the object to be charged. However, the two do not need to be in contact.

In an experiment in which temperature and relative humidity were 32.5° C. and 80%, respectively, and an image forming apparatus was not equipped with a cleaning apparatus, and therefore, the by-products of discharge could not be removed from the photosensitive drum, as an image forming operation was continued, the minimum instantaneous current of the abnormal discharge current substantially reduced compared to the maximum instantaneous current of the abnormal discharge current at the beginning of the operation when the by-products of discharge had not adhered to the photosensitive drum. In this condition, however, the surface resistance of the photosensitive drum had substantially reduced. Therefore, the images outputted using the photosensitive drum in the above described condition appeared smeared. In comparison, when the by-products of discharge had not excessively adhered to the peripheral surface of the photosensitive drum, and the conditions for preventing the unsatisfactory charging of the photosensitive drum were met, it was confirmed that the changes in the properties of the AC voltage always resulted in the occurrences of the abnormal discharge current.

Thus, in order to prevent the phenomenon that as a substantial amount of the by-products of discharge adheres to the peripheral surface of an object to be charged, the occurrences of the abnormal discharge current stops, a cleaning apparatus may be provided as a means for removing the by-products of discharge from the peripheral surface of the object to be charged.

In this embodiment, the image forming apparatus was an electrophotographic printer. However, the application of the present invention does not need to be limited to an electrophotographic printer. In other words, the present invention is applicable to any image forming apparatus, for example, an electrostatic recording apparatus, which forms an image by charging an image bearing member.

Embodiment 2

In the first embodiment, the peak-to-peak voltage Vpp of the AC voltage applied to a charging member was varied. In the second embodiment, the effective value Iac of the alternating current is varied. In this embodiment, the AC power source 11 has a function of keeping constant the effective value of the alternating current.

The power source control circuit 14*c* has a function of turning on or off the abovementioned DC power source 11*a* and AC power source 11*b* of the charge bias power source 11 in such a manner that either DC or AC voltage, or both DC and AC voltages, are applied to the charge roller 2, and a function of controlling the DC voltage to be applied to the charge roller 2 from the DC power source 11*a*, and the effective value of the alternating current which flows as AC voltage is applied to the charge roller 2 from the AC power source 11*b*.

As an example, the case in which the photosensitive drum 1, charge roller 2, electrophotographic printer, charge current measurement circuit 15, phase detection circuit 16, and pre-exposing apparatus 17, which are similar to those in the first embodiment, will be described.

The charge bias applied to the charging member is the combination of a DC voltage (−600 V), and an AC voltage (f1 kHz in frequency and sinusoidal in waveform), and the effective value Iac of the alternating current of the AC voltage is varied.

In this case, the Iac corresponds one for one to the Vpp. Therefore, the Iac is obtained through a charge bias control process similar to that in the first embodiment, and based on the value of this Iac, the optimal value for the peak-to-peak voltage of the AC voltage applied to the charging member is deduced.

Next, the method for determining such AC voltage that generates discharge by only the minimum amount necessary to satisfactorily charge the photosensitive drum, that is, without causing the improper charging of the photosensitive drum, will be described.

The conditions under which the abnormal discharge current occurs, the method for measuring the abnormal discharge current, and the statistical processing method, in this embodiment are the same as those in the first embodiment. The specific frequency f1 satisfies: ft≧10,000, or ft≧10·f. It is assumed that when the maximum instantaneous current of the current with a specific frequency is greater than 0.2 mA, such abnormal discharge current that affects image quality is occurring.

As the amount by which the Iac is to be varied to vary the AC bias to detect the occurrences of the abnormal discharge current falls below a certain threshold value, varying of the Iac is stopped. The following is the description of the method for determining the specific threshold value.

The lengths of time it takes for the photosensitive drum 1 and charge roller 2 to rotate once are 0.942 second and 0.377 second, respectively. It is assumed that when the effective value of a given alternating current, which generates the abnormal discharge current per oscillatory cycle during the measurement period is Iac9; the effective value of the alternating current which does not generate abnormal discharge current at all is Iac10; and the effective value of the alternating current, which does not generate the abnormal discharge current only during some of the oscillatory cycles is Iac11, and the charge current is measured for one second, which is longer than both lengths of time it takes for the photosensitive drum 1 and charge roller 2 to rotate once, an inequality: Iac9 <Iac11 <Iac10, is satisfied.

In this case, the minimum amount δImin by which the Iac is varied between any sequential two steps in the charge control process must be less than |Iac10-Iac11|, because as the photosensitive drum 1 and charge roller 2 rotate, the condition under which the charging nip is formed changes, changing thereby the condition under which the abnormal discharge current occurs. In this embodiment, |Iac10-Iac11|=0.0145 mA. Thus, in order to precisely determine the minimum amount of Iac to be induced by the AC voltage of the charge bias, the minimum amount δImin by which the Iac is to be varied between sequential two steps was set to 0.005 mA.

Next, the method for determining the Iac to be generated by the AC voltage of the optimal charge bias, by varying the Iac will be described. In the case of the AC bias applied to the charging member in this embodiment, the effective value of the alternating current generated by the AC voltage applied to the charging member was Iac; the minimum peak-to-peak voltage which generates abnormal discharge current was Iac1; the maximum peak-to-peak voltage which generates abnormal discharge current was Iac2; and the smallest of all the values of |Iac2-Iac1| under various conditions inclusive of individual differences among charge rollers, different ambiences, manners of usage, was δI1.

In the experiment, δI1 was obtained by examining the differences in Iac among the plurality of charge rollers 2 resulting from the difference in manufacturing lot, the difference in Iac between an ambience in which temperature and relative humidity were 32.5° C. and 80%, respectively, and an ambience in which temperature and relative humidity were 15° C. and 10%, and difference in Iac between the early and late stage of the apparatus usage.

Figure 19:
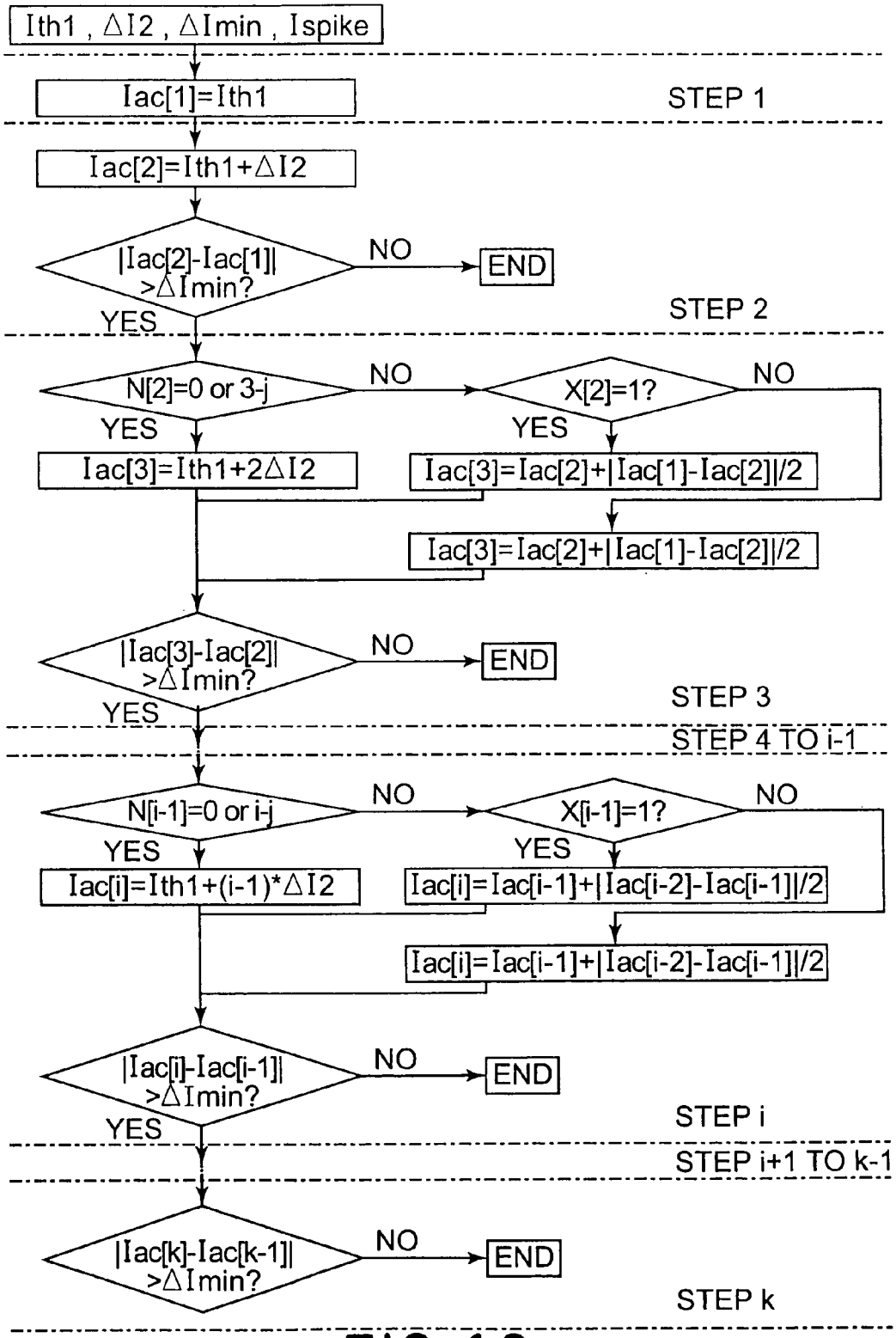
FIG. 19 is a flowchart for obtaining the Iac of the charge bias.

FIG. 19 is the flowchart used for determining the value of Iac to be generated by the optimal charge bias, by using the minimum amount δI2, which is smaller than δI1 (δI1>δI2).

The amount by which Iac generated by the AC voltage of the charge bias applied to the charging member is to be varied between sequential two steps is:

$$\delta I2\delta\times 2^{-n}(n=0,1,2,3,\ldots).$$

Described next will be the details of the flowchart for determining the effective value Iac1 of the minimum alternating current, the maximum instantaneous current of the abnormal discharge current of which always remains below a predetermined value Ispike, when a combination of specific photosensitive drum, charge roller, and electrophotographic printer main assembly is used.

FIG. 19 is the flowchart for determining the Iac of the charge bias.

When the photosensitive drum, charge roller, and/or main assembly of an electrophotographic apparatus is switched, the average value Vth1 of the Vth of the charging station of the charging apparatus to be controlled is to be determined in advance under H/H ambience, for the following reason.

That is, as long as Iac is greater than Ith1 which is the effective value of the alternating current which flows when Vpp is 2Vth1, there are always areas in which the abnormal discharge current is generated, regardless of charging condition.

Ith1 is stored in the statistical processing circuit 14*b* of the charge bias control circuit 14.

The factor δI2 which determines the amount by which the Iac is changed between any sequential two steps, minimum amount δImin by which the Iac is changed between sequential two steps, threshold value Ispike as the referential value for determining whether or not the abnormal discharge current has occurred, based on the maximum instantaneous current of the current with specific frequency, are set. In this embodiment, when the current was flowing by a amount greater than 0.2 mA, it was determined that the abnormal discharge current was flowing.

In each of the steps in which the abnormal discharge current is measured by varying the Iac, it is determined whether or not the average value of the maximum instantaneous current of the abnormal discharge current exceeds Ispike. If it exceeds 1 is outputted, and when it does not exceed, 0 is outputted.

In the following, Iac[i] is the value of the Iac of the AC voltage discriminated in the i-th step; N[i] is the number of 1s outputted before the end of the i-th step; X[i] is the value of the output in the i-th step; and j is ordinal number of the step in which 1 is outputted for the first time.

The Iac is varied according to the following logical formula:

In Step 1 (i=1), Iac[1]=Ith1

In Step 2 (i=2), Iac[2]=Ith1−δI2

In Step 3 and thereafter, (i≧3), if N[i−1]=0, Iac[i]=Ith1−(i−1)*δI2 if N[i−1]=i−j, Iac[i]=Ith1−(i−1)*δI2 if 0<[N[i−1]<i−j, and X[i−1]=0 Iac[i]=Iac[i−1]−|Iac[i−2]−Iac[i−1]|/2 if 0<[N[i−1]<i−j, and X[i−1]=1 Iac[i]=Iac[i−1]+|Iac[i−2]−Iac[i−1]|/2.

After the completion of each step, it is determined which is larger, |Iac[i−1]−Iac[i]|, that is, the amount by which the Iac was varied between any sequential two steps, and δImin, that is, the minimum amount by which the Iac was varied between the sequential two steps. If the former is greater, the next step is taken, whereas if the former is smaller, the Iac is varied, ending the charge bias control process for measuring the abnormal discharge current by varying the Iac.

When ending the charge bias control process, the value of the Iac in the last step in which the last output value became 0 is employed as the minimum peak-to-peak value Iac1 for the AC voltage to be applied to the charging member.

In this embodiment, δI1=0.121 mA; Ith1=0.510 mA; δImin=0.005 mA; and Ispike=0.2 mA. For measurement accuracy, δI2 is set to 0.100 mA.

Figure 20:
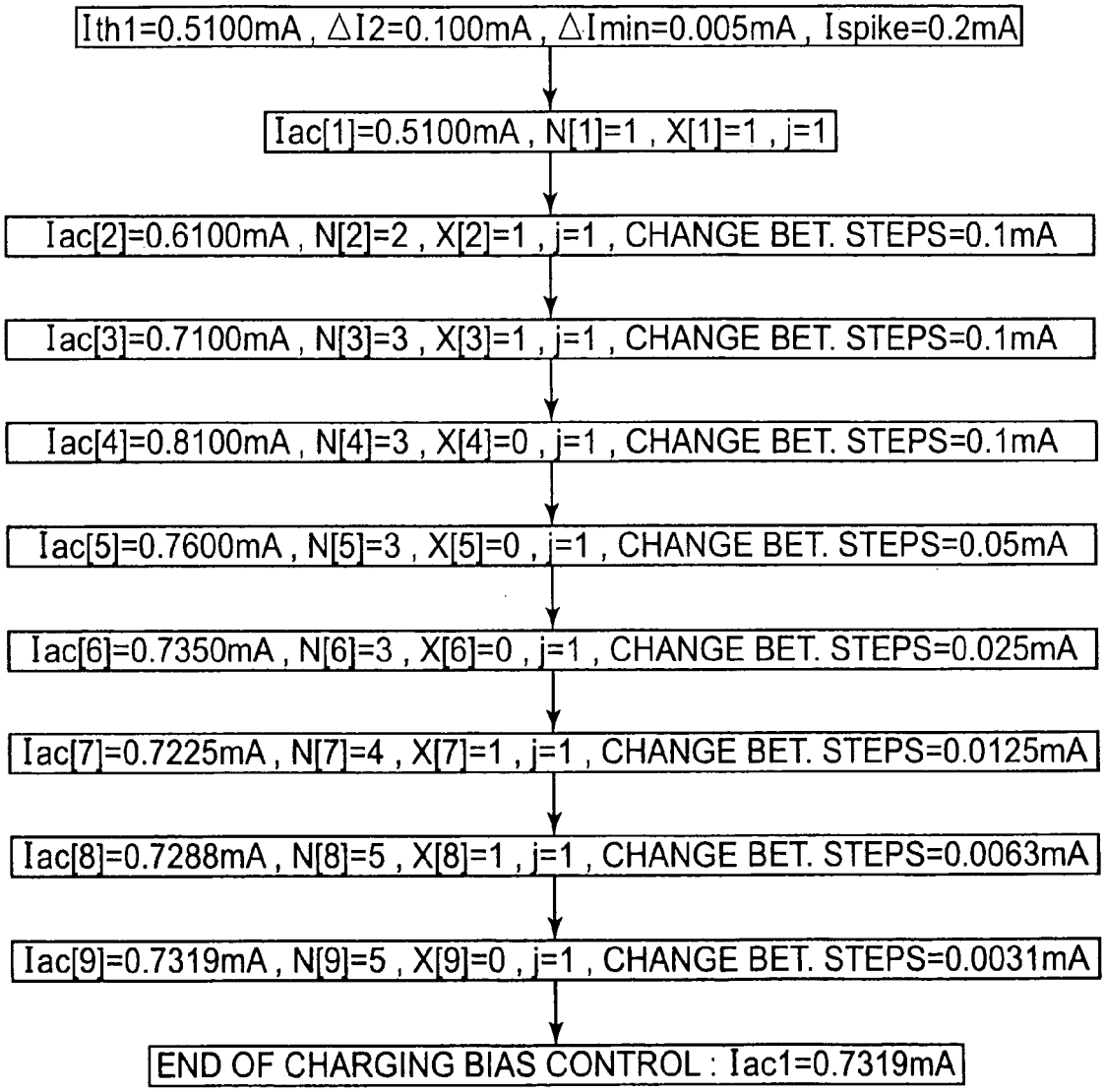
FIG. 20 is a flowchart followed to actually obtaining the Iac of the charge bias in the second embodiment.

Under the above described conditions, the minimum value of the Iac at which the maximum instantaneous current of the abnormal discharge current remained below 0.2 mA for a length of time substantially longer than the length of time it took for the charge roller to rotate once, was 0.7295 V. Thus, the Iac1=0.7319 mA as shown in FIG. 20. Incidentally, the minimum unit of measurement of the Iac was 0.0001 mA.

Ordinarily, the value obtained by adding a predetermined offset current of δIac1 for reliably charging the photosensitive drum 1, to the Iac1 obtained through the above described charge bias control process, is used as the effective value for the alternating current generated by the AC voltage to be actually applied to the charging member, for the following reasons.

That is, there are areas, in which the maximum instantaneous current of the abnormal discharge current fluctuates around 0.2 mA due to the state of the rotation of the photosensitive drum 1 and charge roller 2, which results in measurement errors. However, with the addition of a proper offset current value Iac1, the charging errors do not occur even for a period substantially longer than the time it takes for the charge roller 2 to rotate once.

In the case of the above described example, the offset current value δIac1 was set to 0.010 mA (δIac1=0.010 mA), and the effective value of the alternating current to be generated by the AC voltage to be applied to the charging member was set to 0.740 mA. As a result, images of good quality were obtained, proving that the photosensitive drum 1 was uniformly charged.

As will be evident from the above description, the charge bias can also be determined with the use of the effective value of alternating current.

The Ith1 does not need to be exact. Therefore, the Ith does not need to be frequently reset. In other words, Ith1 may be obtained under the conditions under which a specific photosensitive drum, charge roller, and/or electrophotographic printer main assembly are used.

Further, δI2 does not need to be exact. In other words, a value deduced based on experience, that is, a value deduced from the data of the previous occurrences of the abnormal discharge current, may be used, as long as the value is smaller than the value of the Iac which generates the abnormal discharge current.

Therefore, as long as the variables used for the charge bias control are set, the length of time necessary to determine the charge bias is only the length of time necessary to find out the conditions under which the abnormal discharge current occurs, by varying the Iac. In other words, the charge bias can be controlled in an extremely short length of time.

Embodiment 3

In this embodiment, the method for determining the charge bias by varying the Vpp of the AC voltage, when the difference δV between the surface potential level of a photosensitive drum, on the upstream side of the charging station, and the potential level of the DC voltage applied to a charge roller is small during a charge bias control process, is shown.

The charge bias is determined by varying the Vpp of the AC voltage.

In the following description of the third embodiment of the present invention, Vd is the potential level to which the photosensitive drum is charged during an image forming operation, and Iac is the effective value of the alternating current. Isp is the maximum instantaneous current of the largest abnormal discharge current among all the abnormal discharge currents which occur under all of the variations of the AC voltage. Each case will be separately described.

The photosensitive drum 1, charge roller 2, electrophotographic printer, charge bias control circuit 14, charge current measurement circuit 15, phase detection circuit 16, and pre-exposing apparatus 17 in the embodiment are the same as those in the first embodiment.

1) Case in which δV<|Vd| and Iac<Isp, during charge bias control

Under this condition, the optimal AC voltage to be applied to the charge roller can be determined using a charge bias control process similar to that in the first embodiment.

Referring to FIG. 11, the condition that Vd =−600 V, and the difference between the surface potential level on the upstream side of the charging station and the potential level of the DC voltage applied to the charge roller is no less than roughly 450 V is comparable to this case.

2) Case in which δV<|Vd| and Iac>Isp, and when the difference between the surface potential level on the upstream side of the charging station and the potential level of the DC voltage applied to the charge roller is |Vd|, Iac<Isp, during charge bias control.

Under this condition, control is possible by confirming the state of the abnormal discharge current which occurs when the difference between the surface potential level on the upstream side of the charging station and the potential level of the DC voltage applied to the charge roller is |Vd|, and comparing the confirmed state of the abnormal discharge current with the state of the abnormal discharge current which occurred when the difference was δV. In other words, by matching the maximum instantaneous current of the abnormal discharge current which causes charging errors when the potential level difference is |Vd|, to the maximum instantaneous current of the abnormal discharge current which causes charge errors when the potential level difference is δV, a charge bias control process similar to that in the first embodiment can be carried out.

Referring to FIG. 11, the condition that Vd =−600 V, and the difference between the surface potential level on the upstream side of the charging station and the potential level of the DC voltage applied to the charge roller is no more than roughly 400 V is comparable to this case.

However, δV needs to be set so that the Iac becomes no less than the level of accuracy at which the abnormal discharge current is measured, in other words, the SN (signal to noise) ratio of the abnormal discharge current becomes no less than 1.

3) Case in which δV=|Vd| and Iac>Isp, during charge bias control

Under this condition, the difference between the surface potential level on the upstream side of the charging station and the potential level of the DC voltage applied to the charge roller is small. Therefore, the maximum instantaneous current of the abnormal discharge current remains small even if the properties of the AC voltage are varied. Therefore, the number of occurrences of the abnormal discharge current directly connected to the local image defect is small. However, as the maximum instantaneous current of the abnormal discharge current settles to a value below a certain threshold value, the Vd becomes close to the potential level of the DC charge voltage, improving thereby the uniformity with which the photosensitive drum is charged, which characterizes this case, and which can be used as the index for evaluating the adequacy of charge.

By discretionarily varying the threshold value for discriminating the maximum instantaneous current of the abnormal discharge current as shown in FIG. 13, a charge bias control process similar to that in the first embodiment can be carried out to find out a charge bias which minimizes discharge while preventing charging errors.

Referring to FIG. 11, the condition that Vd is no more than roughly 400 V is comparable to this case.

This case is characterized in that because the difference between the surface potential level of the photosensitive drum on the upstream side of the charging station and the potential level of the DC voltage applied to the charge roller is small, it is difficult for developer to be developed. However, the maximum instantaneous current of the abnormal discharge current is small. Therefore, the amount of measurement error is large, which is one of the shortcomings of this case. However, δV needs to be set to such a value that makes the amount of the Iac no less than the level of accuracy at which the abnormal discharge current is measured, in other words, such a value that makes the S/N ratio of the abnormal discharge current greater than 1.

As described above, even when the difference between the surface potential level of the photosensitive drum on the upstream side of the charging station and the potential level of the DC voltage applied to the charge roller is small, and also, the maximum instantaneous current of the abnormal discharge current is small, the optimal charge bias can be determined by varying the Vpp.

In this embodiment, when the maximum instantaneous current of the abnormal discharge current was no more than 0.05 mA, the charge bias could not be controlled, because the value of the maximum instantaneous current of the abnormal discharge current became roughly the same as the error in the measured value of the abnormal discharge current. However, if it is possible to measure the abnormal discharge current at a higher level of accuracy, by improving the current extraction circuit for extracting the current with a specific frequency, in accuracy, for example, the charge bias can be controlled even if the maximum instantaneous current of the abnormal discharge current is below this value.

Also in this embodiment, the effective value Iac of the alternating current was used as the referential value for discriminating the maximum instantaneous current Isp of the largest abnormal discharge current among all the abnormal discharge currents generated by all the AC voltages different in specifications. However, the referential value does not need to be limited to the effective value Iac. For example, in this embodiment, 0.5 mA could be used as the referential value for classifying the conditions under which the charge bias is to be controlled.

Embodiment 4

This embodiment relates to when the difference δV between the surface potential level of the photosensitive drum on the upstream side of the charging station and the potential level of the DC voltage applied to the charge roller is small, and the charge bias is determined by varying the Iac.

In this embodiment, the conditions under which the abnormal discharge current occurs are divided into three cases, as they were in the third embodiment. The method in this embodiment for determining the optimal charge bias by varying the alternating current Iac is roughly the same as that in the second embodiment.

As described above, even if the difference between the surface potential level of the photosensitive drum on the upstream side of the charging station and the potential level of the DC voltage applied to the charge roller is small, and the maximum instantaneous current of the abnormal discharge current is small, the optimal charge bias can be determined by varying the Iac.

Embodiment 5

In the first to fourth embodiments, the occurrences of the abnormal discharge current which result in the unsatisfactory charging of the photosensitive drum is detected by measuring the abnormal discharge current, and the charge bias is controlled based on the results of the detection. In this embodiment, however, the occurrences of the abnormal discharge current which result in the unsatisfactory charging of the photosensitive drum are detected by measuring the light generated by the abnormal discharge current, and the charge bias is controlled based on the results of the detection.

The image forming apparatus in this embodiment is the same electrophotographic printer as that in the first embodiment, and the structure of the charge roller in this embodiment is the same as that in the first embodiment.

Figure 22:
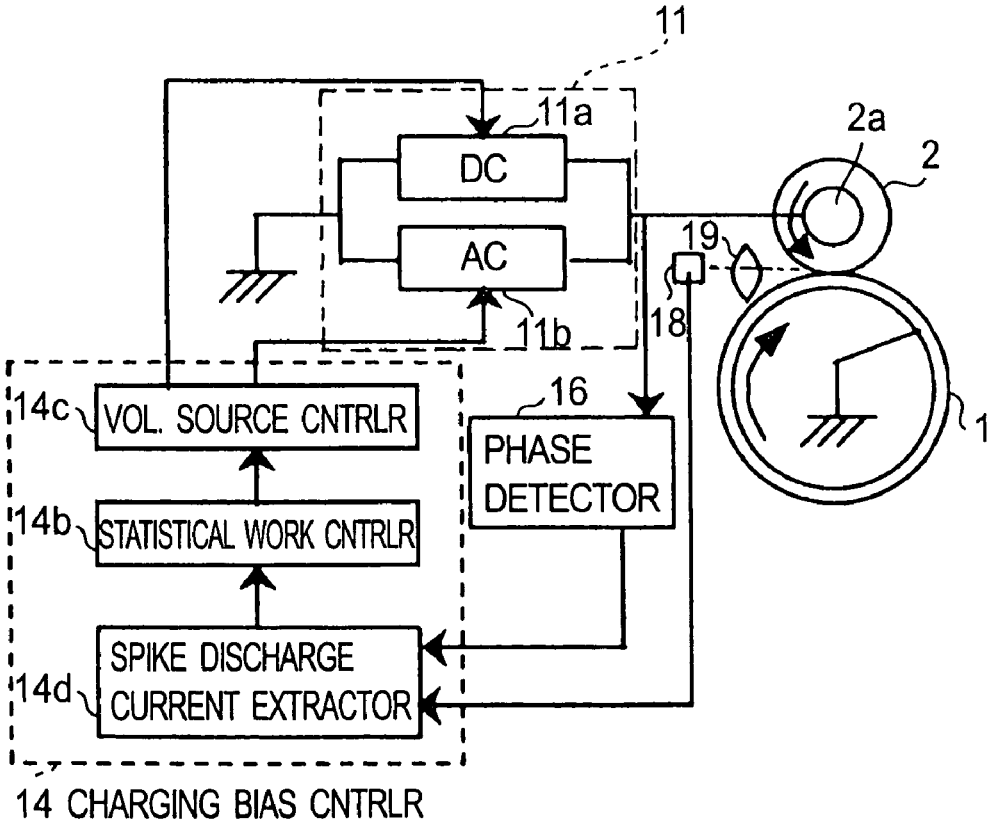
FIG. 22 is a schematic drawing showing the general structure of the charging apparatus in the fifth embodiment of the present invention.

FIG. 22 is a schematic drawing of the charging apparatus in the fifth embodiment. As the charge bias, which is the combination of AC and DC voltages, is applied to the charge roller 2 from the charge bias power source 11 through the metallic core 2*a* of the charge roller 2, the peripheral surface of the photosensitive drum 1, which is being rotated, is charged to a predetermined potential level.

The charge bias power source 11 for applying voltage to the charge roller 2 is provided with the DC power source 11*a* and AC power source 11*b*.

Designated by a referential number 18 is a photodiode array. Since the abnormal discharge light occurs on the upstream side of the charging station, the photodiode array is disposed on the upstream side of the charging station. Its sensitivity is high in the wide wavelength range of 380 nm-700 nm. It is capable of measuring the abnormal discharge current light across the entire lengthwise range of the charging member.

Designated by a referential number 19 is a condenser lens, which condenses the discharge light, which occurs upstream of the charging station, onto the photodiode array 18.

The discharge light is converted into electrical current by the photodiode array 18, and the resultant current is inputted into the control circuit 14, which will be described next.

Designated by a referential number 14 is a charge bias control circuit, which comprises a current extraction circuit 14*d* for extracting the current generated by the discharge light generated by the abnormal discharge, a statistical process circuit 14*b*, and a power source control circuit 14*c*.

The abnormal discharge light current extraction circuit 14*a* has a function of amplifying the current from the photodiode array 18, and extracting from the current, the component attributable to the light generated by the abnormal discharge.

The statistical processing circuit 14*b* has a function of statistically processing the data which the current component attributable the light effected by the abnormal discharge, inputted from the abnormal discharge light extraction circuit 14*d*, carries, using a predetermined method, and a function of outputting a command for controlling the power source control circuit 14*c*, based on the results of the process.

The power source control circuit 14*c* has a function of turning on or off the abovementioned DC power source 11*a* and AC power source 11*b* of the charge bias power source 11 in such a manner that either DC or AC voltage, or both DC and AC voltages, are applied to the charge roller 2, and a function of controlling the DC voltage to be applied to the charge roller 2 from the DC power source 11*a*, and the peak-to-peak voltage of the AC voltage to be applied to the charge roller 2 from the AC power source 11*b*.

The charge bias control circuit 14, which is an integration of these circuits 14*d*, 14*b*, and 14*c*, has a function of controlling the AC voltage to be applied to the charge roller 2, based on the data borne by the photocurrent generated in the photodiode array 18, in order to control the AC voltage so that only the minimum amount of discharge necessary to charge the photosensitive drum is induced between the photosensitive drum 1 and charge roller 2 while preventing the photosensitive drum 1 from being unsatisfactorily charged.

Designated by a referential number 16 is a phase detection circuit, which has a function of detecting the phase of the charge bias.

Designated by a referential number 17 is the pre-exposing apparatus, which exposes the peripheral surface of the photosensitive drum, on the upstream side of the charging station, to reduce the potential level of the peripheral surface of the photosensitive drum to 0 V. It also has a function of providing a difference between the surface potential level of the photosensitive drum 1 on the upstream side of the charging station, and the potential level of the DC voltage applied to the charge roller 2, in order to assure that there will be such AC voltage that generates abnormal discharge current which is no less than a predetermined value in the maximum instantaneous current.

The threshold value for the maximum instantaneous photocurrent of the abnormal discharge photocurrent, at which unsatisfactory charging of the photosensitive drum does not occur, is set so that if the maximum instantaneous photocurrent is larger than the threshold value, the abnormal discharge occurs, whereas if it is no more than the threshold value, the abnormal discharge does not occur.

The charge bias can be controlled by confirming the occurrences or nonoccurrence of the abnormal discharge, by varying the charge bias, as it could in the first to fourth embodiments.

Incidentally, in this embodiment, the high voltage power sources, such as the development power source, transfer power source, etc., other than the power source for the charging apparatus, are independent from the power source for the charging apparatus, in terms of circuit design. Therefore, even if they generate high voltage, the noises from them are small, assuring that the charge bias can be reliably controlled.

In this embodiment, a photodiode array 18, which converts light into electric current, is employed as a means for detecting the abnormal photocurrent. However, the means for detecting the abnormal photocurrent does not need to be limited to a photodiode array.

Embodiment 6

In the first to fifth embodiments, the pre-exposing apparatus 17 is used as the means for providing a predetermined amount of difference between the surface potential level of the photosensitive drum on the upstream side of the charging station, and the potential level of the DC voltage applied to the charging roller. However, the present invention does not need to be limited the choice of the means for providing the above described difference, to the pre-exposing apparatus 17. In other words, any means may be employed in place of the pre-exposing apparatus 17, as long as it is capable of providing a predetermined amount of difference between the surface potential level of the photosensitive drum on the upstream side of the charging station, and the potential level of the DC voltage applied to the charging roller.

More specifically, during the first rotation of the photosensitive drum after the beginning of the process for charging the photosensitive drum, there is a certain amount of difference between the surface potential level of the photosensitive drum and the potential level of the DC voltage of the charge bias.

Further, it is possible to provide a certain amount of difference between the surface potential level of the photosensitive drum and the DC voltage of the charge bias, by varying the DC voltage, without varying the AC voltage of the charge bias, for a predetermined length of time.

Thus, the charge bias control process in accordance with the present invention can be carried out without providing an additional means for providing a predetermined amount of difference between the surface potential level of the photosensitive drum on the upstream side of the charging station, and the potential level of the DC voltage applied to the charging roller.

Although in the above described embodiments of the present invention, the present invention was described as the method for controlling the process for charging the image bearing member of an image forming apparatus, the application of the charging process controlling method in accordance with the present invention is not limited to the method for controlling the process for charging the image bearing member. Obviously, it is effective as a means for controlling the process for charging a wide range of objects to be charged.

The above described embodiments of the present invention are not intended to limit the scope of the present invention.

The present invention is applicable to any voltage control process involved with current with a specific frequency.

All that is necessary is to discriminate a first alternating voltage which generates abnormal discharge current, from a second alternating voltage which generates no abnormal discharge current, and then, to control the charge bias so that the second alternating voltage is applied to a charging apparatus.

For example, the alternating voltage applied to charge the image formation area of the peripheral surface of a photoconductive member may be controlled based on the maximum instantaneous current of current with a specific frequency. In this case, when charging the image formation area of the peripheral surface of the photosensitive drum, the alternating voltage to be applied to a charging means is varied in peak-to-peak voltage until the first alternating voltage which generates the abnormal discharge current, the maximum instantaneous current of which is of the current with a specific frequency, of which is greater than a predetermined value, and the second alternating voltage which is greater in peak-to-peak voltage than the first alternating voltage, and the maximum instantaneous current of the current with a specific frequency, of which is less than the predetermined value, are obtained. Then, when charging the image formation area, the alternating voltage applied to the charging means is controlled based on the second alternating voltage.

When charging the image formation area of the peripheral surface of a photosensitive drum, the alternating voltage may be controlled based on the number of the occurrences of the current with a specific frequency. In this case, the alternating voltage to be applied to a charging means is varied in peak-to-peak voltage until the first alternating voltage, which is greater in a predetermined value in the number of the occurrences of the current with a specific frequency, and the second alternating voltage which is greater in peak-to-peak value than the first alternating current, and is smaller than the predetermined value in the number of the occurrences of the current with the specific frequency, are obtained. Then, when charging the image formation area of the peripheral surface of the photosensitive drum, the alternating voltage applied to the charging means is controlled based on the second alternating voltage.

Further, the alternating voltage applied to charge the image formation area may be controlled with reference to the length of time the current with a specific frequency flows. In this case, the alternating voltage to be applied to a charging means is varied in peak-to-peak voltage, until the first alternating voltage, which is greater in a predetermined value in the length of time the current with a specific frequency flows, and the second alternating voltage which is greater in peak-to-peak value than the first alternating current, and is smaller than the predetermined value in the length of time the current with a specific frequency flows, are obtained. Then, when charging the image formation area of the peripheral surface of the photosensitive drum, the alternating voltage applied to the charging means is controlled with reference to the second alternating voltage.

Further, the alternating voltage applied to charge the image formation area may be controlled with reference to the integrated value, over elapsed time, of the current with a specific frequency. In this case, the alternating voltage to be applied to a charging means is varied in peak-to-peak voltage, until the first alternating voltage, which is greater in a predetermined value in the integrated value, over elapsed time, of the current with specific frequency, and the second alternating voltage which is greater in peak-to-peak value than the first alternating current, and is smaller than the predetermined value in the integrated value, over elapsed time, of the current with specific frequency, are obtained. Then, when charging the image formation area of the peripheral surface of the photosensitive drum, the alternating voltage applied to the charging means is controlled with reference to the second alternating voltage.

Incidentally, it is desired that when charging the image formation area, a supplementary peak-to-peak voltage $\delta Vpp$ is added to the Vpp of the alternating voltage. Further, the supplementary peak-to-peak voltage $\delta Vpp$ is desired to be greater than the difference between the largest Vppmax and smallest Vppmin among the peak-to-peak voltages of the plurality of second alternating voltages obtained in a predetermined length time.

Further, when varying in steps the peak-to-peak voltage of the alternating voltage, if the alternating voltage applied to the charging means in one step is the aforementioned first alternating voltage, the alternating voltage applied to the charging member in the following step is made to be such alternating voltage that is greater in peak-to-peak voltage than the first alternating voltage, whereas if the alternating voltage applied to the charging means in one step is the aforementioned second alternating voltage, the alternating voltage applied to the charging member in the following step is made to be such alternating voltage that is smaller in peak-to-peak voltage than the second alternating voltage. With this arrangement, the optimal current to be applied to charge the image formation area can be determined at a higher level of accuracy.

Further, the alternating voltage applied to the charging means may be controlled with reference to the effective value of the current generated by the alternating voltage applied to the charging means, instead of the peak-to-peak voltage used in the preceding methods.

In this case, the alternating voltage to be applied to a charging means is varied in peak-to-peak voltage, until the first alternating voltage, which is greater in a predetermined value in the maximum instantaneous current of the current with a specific frequency, and the second alternating voltage which is smaller in the predetermined value in the maximum instantaneous current of the current with a specific frequency, and the alternating current which generates as it is applied to the charging means is greater than the alternating current which the first alternating voltage generates as it is applied to the charging means, are obtained. Then, when charging the image formation area of the peripheral surface of the photosensitive drum, the alternating voltage applied to the charging means is controlled with reference to the second alternating voltage.

Further, the alternating voltage applied to the charging means may be controlled with reference to the number of the occurrences of the current with a specific frequency. In this case, the alternating voltage to be applied to a charging means is varied in peak-to-peak voltage, until the first alternating voltage, which is greater in a predetermined value in the number of the occurrences of the current with a specific frequency, and the second alternating voltage which is smaller than the predetermined value in the number of the occurrences of the current with the specific frequency, and the alternating current which generates as it is applied to the charging means is greater than the alternating current which the first alternating voltage generates as it is applied to the charging means, are obtained. Then, when charging the image formation area of the peripheral surface of the photosensitive drum, the alternating voltage applied to the charging means is controlled with reference to the second alternating voltage.

Further, the alternating voltage applied to charge the image formation area may be controlled with reference to the length of time the current with a specific frequency flows. In this case, the alternating voltage to be applied to a charging means is varied in peak-to-peak voltage, until the first alternating voltage, which is greater in a predetermined value in the length of time the current with a specific frequency flows, and the second alternating voltage which is smaller than the predetermined value in the length of time the current with a specific frequency flows, and the alternating current which generates as it is applied to the charging means is greater than the alternating current which the first alternating voltage generates as it is applied to the charging means. Then, when charging the image formation area of the peripheral surface of the photosensitive drum, the alternating voltage applied to the charging means can be controlled with reference to the second alternating voltage.

Further, the alternating voltage applied to charge the image formation area may be controlled with reference to the integrated value, over elapsed time, of the current with a specific frequency. In this case, the alternating voltage to be applied to a charging means may be varied in peak-to-peak voltage, until the first alternating voltage, which is greater in a predetermined value in the integrated value, over elapsed time, of the current with specific frequency, and the second alternating voltage which is smaller than the predetermined value in the integrated value, over elapsed time, of the current with specific frequency, and the alternating current which generates as it is applied to the charging means is greater than the alternating current which the first alternating voltage generates as it is applied to the charging means, are obtained. Then, when charging the image formation area of the peripheral surface of the photosensitive drum, the alternating voltage applied to the charging means is controlled with reference to the second alternating voltage.

Incidentally, it is desired that when charging the image formation area, a supplementary offset current δIac is added to the Iac to be generated by the alternating voltage. Further, the supplementary offset current δIac is desired to be greater than the difference between the largest Iacmax and smallest Iacmin among the currents generated by the plurality of second alternating voltages obtained in a predetermined length of time.

Further, when varying in steps the peak-to-peak voltage of the alternating voltage, if the alternating voltage applied to the charging means in one step is the aforementioned first alternating voltage, the alternating voltage applied to the charging member in the following step is made to be such alternating voltage that generates a greater amount of alternating current than the first alternating voltage, whereas if the alternating voltage applied to the charging means in one step is the aforementioned second alternating voltage, the alternating voltage applied to the charging member in the following step is made to be such alternating voltage that generates a smaller amount of alternating current than the second alternating voltage. With this arrangement, the optimal alternating voltage to be applied to charge the image formation area can be determined at a higher level of accuracy.

While the invention has been described with reference to the structures disclosed herein, it is not confined to the details set forth, and this application is intended to cover such modifications or changes as may come within the purposes of the improvements or the scope of the following claims.

What is claimed is:

1. A charging apparatus comprising:

charging means for being supplied with an AC voltage and for electrically charging a member to be charged;

current measuring means for measuring a current flowing between said charging means and the member to be charged when the AC voltage is supplied to said charging means; and abnormal current detecting means for detecting a current having a frequency indicative of abnormal current which is higher than a frequency of the AC voltage.

2. An apparatus according to claim 1, wherein the frequency indicative of abnormal current satisfies ft ≧10000 (Hz) where ft is the frequency indicative of abnormal current.

3. An apparatus according to claim 1, wherein the frequency indicative of abnormal current satisfies ft ≧10·f where ft is the frequency indicative of abnormal current, and f is a frequency of the AC voltage.

4. A charging apparatus comprising:

charging means for being supplied with an AC voltage and for electrically charging a member to be charged;

current measuring means for measuring a current flowing between said charging means and the member to be charged when the AC voltage is supplied to said charging means; and control means for controlling a voltage supplied to said charging means based on an abnormal current having a frequency indicative of abnormal current which is higher than a frequency of the AC voltage when said charging means charges an image forming region of the member to be charged.

5. An apparatus according to claim 4, wherein the frequency indicative of abnormal current satisfies ft ≧10000 (Hz) where ft is the frequency indicative of abnormal current.

6. An apparatus according to claim 4, wherein the frequency indicative of abnormal current satisfies ft ≧10·f where ft is the frequency indicative of abnormal current, and f is a frequency of the AC voltage.

7. An apparatus according to claim 4, wherein the voltage applied to said charging means when the image forming region is charged is an AC voltage having a peak-to-peak voltage which is not less than twice a discharge starting voltage.

8. A charging apparatus comprising:

charging means for being supplied with an AC voltage and for electrically charging a member to be charged;

current measuring means for measuring a current flowing between said charging means and the member to be charged when the AC voltage is supplied to said charging means; and control means for supplying to said charging means a plurality of AC voltages having different peak-to-peak voltages to obtain a plurality of AC voltages of which maximum values of abnormal currents provided by differences between the currents and currents averaged in unit periods are not more than a predetermined value, and for controlling, when said charging apparatus charges an image forming region of the member to be charged, the AC voltage supplied to said charging means based on an AC voltage having a minimum peak-to-peak voltage of such a plurality of AC voltages, wherein the abnormal currents have a frequency indicative of abnormal current which is higher than a frequency of the AC voltage.

9. An apparatus according to claim 8, wherein the frequency indicative of abnormal current satisfies ft ≧10000 (Hz) where ft is the frequency indicative of abnormal current.

10. An apparatus according to claim 8, wherein the frequency indicative of abnormal current satisfies ft ≧10·f where ft is the frequency indicative of abnormal current, and f is a frequency of the AC voltage.

11. An apparatus according to claim 8, wherein the voltage applied to said charging means when the image forming region is charged is an AC voltage having a peak-to-peak voltage which is not less than twice a discharge starting voltage.

12. A charging apparatus comprising:

charging means for being supplied with an AC voltage and for electrically charging a member to be charged;

current measuring means for measuring a current flowing between said charging means and the member to be charged when the AC voltage is supplied to said charging means; and control means for supplying to said charging means a plurality of AC voltages having different peak-to-peak voltages to obtain a plurality of AC voltages of which maximum values of abnormal currents, provided based on a difference between a current and a current component provided by removing from the current a component having a frequency higher than a frequency of the AC voltage, are not more than a predetermined value, and for controlling, when said charging apparatus charges an image forming region of the member to be charged, the AC voltage supplied to said charging means based on an AC voltage having a minimum peak-to-peak voltage of such a plurality of AC voltages.

13. An apparatus according to claim 12, wherein the frequency indicative of abnormal current satisfies ft $\geqq 10000$ (Hz) where ft is the frequency indicative of abnormal current.

14. An apparatus according to claim 12, wherein the frequency indicative of abnormal current satisfies ft $\geqq 10 \cdot f$ where ft is the frequency indicative of abnormal current, and f is a frequency of the AC voltage.

15. An apparatus according to claim 12, wherein the voltage applied to said charging means when the image forming region is charged is an AC voltage having a peak-to-peak voltage which is not less than twice a discharge starting voltage.

* * * * *

UNITED STATES PATENT AND TRADEMARK OFFICE

CERTIFICATE OF CORRECTION

PATENT NO. : 7,424,232 B2
APPLICATION NO. : 11/476137
DATED : September 9, 2008
INVENTOR(S) : Norio Takahashi et al.

It is certified that error appears in the above-identified patent and that said Letters Patent is hereby corrected as shown below:

COLUMN 1:
Line 4, "May 3, 2004." should read -- May 3, 2004, now U.S. Patent No. 7,116,922. --.
Line 49, "above described" should read -- above-described --.

COLUMN 2:
Line 19, "be" should read -- to be --.
Line 20, "abovementioned" should read -- above-mentioned --.

COLUMN 3:
Line 28, "above described" should read -- above-described --.
Line 61, the second occurrence of "the" should be deleted.

COLUMN 4:
Line 1, "abovementioned" should read -- above-mentioned --.
Line 42, "above described" should read -- above-described --.
Line 50, "above described" should read -- above-described --.
Line 59, "above described" should read -- above-described --.
Line 64, "above described" should read -- above-described --.

COLUMN 5:
Line 10, "above described" should read -- above-described --.

COLUMN 6:
Line 65, "length" should read -- length of --.

COLUMN 8:
Line 40, "above described" should read -- above-described --.

COLUMN 11:
Line 27, "from the in" should read -- in the --

COLUMN 15:
Line 22, "above described" should read -- above-described --.
Line 55, "base" should read -- based --.

UNITED STATES PATENT AND TRADEMARK OFFICE

CERTIFICATE OF CORRECTION

PATENT NO. : 7,424,232 B2
APPLICATION NO. : 11/476137
DATED : September 9, 2008
INVENTOR(S) : Norio Takahashi et al.

It is certified that error appears in the above-identified patent and that said Letters Patent is hereby corrected as shown below:

COLUMN 17:
Line 38, “varied;” should read -- varied, --.

COLUMN 18:
Line 22, “above described” should read -- above-described --.
Line 39, “above described” should read -- above-described --.

COLUMN 19:
Line 1, “above described” should read -- above-described --.
Line 7, “above described” should read -- above-described --.
Line 21, the first occurrence of “the” should be deleted.
Line 37, “Also” should read -- Also, --.

COLUMN 21:
Line 54, “above described” should read -- above-described --.

COLUMN 23:
Line 28, “above described” should read -- above-described --.
Line 39, “above described” should read -- above-described --.

COLUMN 25:
Line 47, “above described” should read -- above-described --.
Line 62, “above described” should read -- above-described --.

COLUMN 26:
Line 24, “above described” should read -- above-described --.
Line 45, “above described” should read -- above-described --.

COLUMN 27:
Line 10, “abovementioned” should read -- above-mentioned --.

UNITED STATES PATENT AND TRADEMARK OFFICE

CERTIFICATE OF CORRECTION

PATENT NO. : 7,424,232 B2
APPLICATION NO. : 11/476137
DATED : September 9, 2008
INVENTOR(S) : Norio Takahashi et al.

It is certified that error appears in the above-identified patent and that said Letters Patent is hereby corrected as shown below:

COLUMN 29:
Line 4, “a amount” should read -- an amount --.
Line 42, “above described” should read -- above-described --.
Line 51, “above described” should read -- above-described --.
Line 64, “above described” should read -- above-described --.

COLUMN 33:
Line 33, “abovementioned” should read -- above-mentioned --.

COLUMN 34:
Line 29, “above” should read -- above- --.
Line 55, “above described” should read -- above-described --.
Line 64, “above described” should read -- above-described --.

Signed and Sealed this

Tenth Day of February, 2009

JOHN DOLL
*Acting Director of the United States Patent and Trademark Office*